US007886460B2

(12) United States Patent
Teteriatnikov et al.

(10) Patent No.: US 7,886,460 B2
(45) Date of Patent: Feb. 15, 2011

(54) SHOE

(75) Inventors: Savva Teteriatnikov, Venice, CA (US); David Raysse, Los Angeles, CA (US); Eckhard Knoepke, Redondo Beach, CA (US); Julie Zhu, Redondo Beach, CA (US)

(73) Assignee: Skecher U.S.A., Inc. II, Manhattan Beach, CA (US)

( * ) Notice: Subject to any disclaimer, the term of this patent is extended or adjusted under 35 U.S.C. 154(b) by 0 days.

(21) Appl. No.: 12/834,725

(22) Filed: Jul. 12, 2010

(65) Prior Publication Data

US 2010/0263234 A1 Oct. 21, 2010

Related U.S. Application Data

(63) Continuation of application No. 12/776,253, filed on May 7, 2010, which is a continuation-in-part of application No. 12/557,276, filed on Sep. 10, 2009, now Pat. No. 7,779,557.

(60) Provisional application No. 61/122,911, filed on Dec. 16, 2008.

(51) Int. Cl.
*A43B 13/12* (2006.01)
*A43B 13/14* (2006.01)

(52) U.S. Cl. ..... 36/25 R; 36/30 R; 36/31

(58) Field of Classification Search ..... 36/107, 36/108, 72 A, 30 R, 25 R, 76 R
See application file for complete search history.

(56) References Cited

U.S. PATENT DOCUMENTS

| | | | | |
|---|---|---|---|---|
| 634,586 | A | 10/1899 | Roche | |
| 741,012 | A | 10/1903 | Corey | |
| 1,236,924 | A | 8/1917 | Golden | |
| 3,822,490 | A | 7/1974 | Murawski | |
| 4,155,180 | A | 5/1979 | Phillips | |
| 4,241,523 | A | 12/1980 | Daswick | |
| 4,262,433 | A | 4/1981 | Hagg et al. | |
| D265,017 | S | 6/1982 | Vermonet | |
| 4,348,821 | A | 9/1982 | Daswick | |
| 4,372,059 | A | 2/1983 | Ambrose | |
| 4,399,620 | A | 8/1983 | Funck | |
| 4,439,937 | A * | 4/1984 | Daswick | 36/107 |
| 4,561,140 | A | 12/1985 | Graham et al. | |

(Continued)

FOREIGN PATENT DOCUMENTS

| | | |
|---|---|---|
| EP | 0 560 698 B1 | 3/1993 |

(Continued)

*Primary Examiner*—Marie Patterson
(74) *Attorney, Agent, or Firm*—Marshall A. Lerner; Marvin H. Kleinberg; Kleinberg & Lerner, LLP

(57) ABSTRACT

A shoe having a toe region, a middle region, a heel region, and a multi-layer, multi-density midsole; the midsole being comprised of at least a shank and a lower layer; the bottom surface of the shank having at least one longitudinal concavity and at least one longitudinal convexity, the longitudinal concavity typically occupying a substantial portion of the heel region and the longitudinal convexity typically occupying a portion of the middle region. Collectively, these elements contribute to making the shoe appropriate for both walking and higher impact activities such as running, and simulating the effect, and imparting the fitness benefits, of use on a sandy beach or on a giving or uneven surface regardless of the actual hardness of the surface.

20 Claims, 13 Drawing Sheets

U.S. PATENT DOCUMENTS 4,561,195 A 12/1985 Onoda
4,651,445 A 3/1987 Hannibal
4,654,983 A 4/1987 Graham et al.
4,667,423 A 5/1987 Autry et al.
4,731,939 A 3/1988 Parracho et al.
4,774,774 A 10/1988 Allen, Jr.
4,798,010 A 1/1989 Sugiyama
4,854,057 A * 8/1989 Misevich et al. ..... 36/114
4,858,338 A 8/1989 Schmid
5,014,449 A 5/1991 Richard et al.
5,025,573 A 6/1991 Giese et al.
5,052,130 A 10/1991 Barry et al.
5,060,401 A 10/1991 Whatley
5,191,727 A 3/1993 Barry et al.
5,224,280 A 7/1993 Preman et al.
5,353,523 A 10/1994 Kilgore et al.
5,396,675 A 3/1995 Vincent et al.
5,435,079 A 7/1995 Gallegos
5,528,842 A * 6/1996 Ricci et al. ..... 36/27
5,537,762 A 7/1996 Walters
5,572,805 A * 11/1996 Giese et al. ..... 36/30 R
5,579,591 A 12/1996 Kousaka et al.
5,592,757 A 1/1997 Jackinsky
5,685,090 A 11/1997 Tawney et al.
5,694,706 A 12/1997 Penka
5,718,064 A 2/1998 Pyle
5,727,335 A 3/1998 Kousaka et al.
RE35,905 E 9/1998 Vincent et al.
5,822,886 A 10/1998 Luthi et al.
D411,909 S 7/1999 Lavertue et al.
5,921,004 A 7/1999 Lyden
5,974,699 A 11/1999 Park
6,055,746 A 5/2000 Lyden et al.
6,205,681 B1 3/2001 Kita
6,289,608 B1 9/2001 Kita et al.
6,311,414 B1 11/2001 Kita
6,338,207 B1 1/2002 Chang
6,341,432 B1 1/2002 Muller
6,505,421 B1 * 1/2003 Vaz ..... 36/30 R
D474,581 S 5/2003 Cooper
6,625,905 B2 * 9/2003 Kita ..... 36/30 R
6,647,645 B2 * 11/2003 Kita ..... 36/28
6,782,639 B1 8/2004 Muller
6,782,641 B2 8/2004 Turner et al.
6,785,984 B2 9/2004 Jackinsky
6,807,752 B2 10/2004 Nakano et al.
D499,535 S 12/2004 McClaskie
6,944,972 B2 9/2005 Schmid
6,964,119 B2 11/2005 Weaver, III
7,010,867 B2 3/2006 Brown
7,013,583 B2 3/2006 Greene et al.
7,033,533 B2 4/2006 Lewis-Auburn et al.
7,036,246 B2 5/2006 Otis et al.
7,048,881 B2 5/2006 Otis et al.
D523,628 S 6/2006 Young
7,107,704 B2 9/2006 Dennis et al.
7,111,415 B2 9/2006 Hockerson
D530,905 S 10/2006 Jonsson
7,150,114 B2 12/2006 Park
7,159,339 B2 * 1/2007 Mathieu et al. ..... 36/30 R
7,162,815 B2 1/2007 Miyauchi et al.
7,266,912 B2 9/2007 Whatley
7,287,341 B2 10/2007 Ellis, III
7,299,505 B2 11/2007 Dennis et al.
7,334,349 B2 2/2008 Sokolowski et al.
7,353,626 B2 4/2008 Otis et al.
7,380,350 B2 6/2008 Meschan
7,398,608 B2 * 7/2008 Schoenborn ..... 36/28
7,401,418 B2 7/2008 Wyszynski et al.
7,421,808 B2 9/2008 Baier
7,434,337 B2 10/2008 Gibert et al.
7,464,428 B2 12/2008 Norton
7,484,317 B2 2/2009 Kita et al.
7,513,065 B2 4/2009 Kita et al.
7,536,809 B2 5/2009 Meschan
7,540,099 B2 6/2009 Meschan
7,540,100 B2 6/2009 Pawlus
7,549,236 B2 6/2009 Dillon et al.
7,562,468 B2 7/2009 Ellis, III
7,596,888 B2 10/2009 Meschan
7,603,794 B2 10/2009 Oh
7,624,515 B2 12/2009 Kita et al.
7,627,961 B2 12/2009 Brewer et al.
7,640,679 B2 1/2010 Sokolowski
D608,990 S 2/2010 Truelsen
2003/0000108 A1 1/2003 Kita
2003/0005600 A1 1/2003 Kita
2004/0107601 A1 6/2004 Schmid
2004/0154188 A1 8/2004 Laska
2005/0000115 A1 1/2005 Kimura et al.
2006/0137228 A1 6/2006 Kubo et al.
2006/0254093 A1 11/2006 Fuchslocher
2006/0277798 A1 12/2006 Reilly et al.
2007/0028484 A1 2/2007 Akhidime
2007/0101617 A1 5/2007 Brewer et al.
2007/0113425 A1 5/2007 Wakley et al.
2007/0220778 A1 9/2007 Fusco et al.
2007/0294915 A1 12/2007 Ryu
2008/0016724 A1 1/2008 Hlavac
2008/0034615 A1 2/2008 Nishiwaki
2008/0052965 A1 3/2008 Sato
2008/0163513 A1 7/2008 Chapman
2008/0229624 A1 9/2008 Mueller
2008/0256827 A1 10/2008 Hardy
2008/0289220 A1 11/2008 Rivas et al.
2009/0031584 A1 2/2009 Rasmussen
2009/0056165 A1 3/2009 Lee
2009/0077830 A1 3/2009 Lee
2009/0100709 A1 4/2009 Macey et al.
2009/0113757 A1 5/2009 Banik
2009/0113758 A1 5/2009 Nishiwaki et al.
2009/0151201 A1 6/2009 Lee
2009/0183393 A1 7/2009 Lee
2009/0241373 A1 10/2009 Kita et al.

FOREIGN PATENT DOCUMENTS

EP 0 560 698 A1 9/1993
EP 0 999 764 B1 5/2003
EP 1 124 462 B1 10/2004
EP 2 070 434 A1 6/2009
EP 2 080 443 A1 7/2009
GB 811884 A 4/1959
JP 58-91906 6/1963
JP 50-135334 11/1975
JP 57-81301 5/1982
JP 57-188201 11/1982
JP 58-190401 11/1983
JP 60-150701 8/1985
JP 61-31101 2/1986
JP 61-154503 7/1986
JP 1-110603 7/1989
JP 2001-520528 10/2001
JP 2003-19004 1/2003
JP 2006-204712 8/2006
JP 2006-247218 9/2006
JP 3917521 2/2007
JP 2009-135814 7/2009
WO WO 99/03368 A1 1/1999
WO WO 01/15560 A1 3/2001
WO WO 2005/067754 A1 7/2005
WO WO 2008/143465 A1 11/2008
WO 2009/047272 A1 4/2009
WO WO 2009/069871 A1 6/2009

WO WO 2009/069926 A1 6/2009
WO WO 2009/075436 A1 6/2009
WO WO 2009/082164 A1 7/2009
WO WO 2009/091106 A1 7/2009

* cited by examiner

SHOE

CROSS-REFERENCE TO RELATED APPLICATIONS

This application is a continuation of patent application Ser. No. 12/776,253 filed on May 7, 2010 which is a continuation in part of patent application Ser. No. 12/557,276 filed on Sep. 10, 2009 which claims the benefit of priority based on U.S. Provisional Application No. 61/122,911 filed Dec. 16, 2008.

BACKGROUND OF THE INVENTION

1. Field of the Invention

The present invention relates to footwear and, in particular, to a shoe with fitness benefits which can be used during high impact activities such as running. The fitness benefits are imparted by a unique running or walking motion which is induced primarily by the shoe's midsole. The midsole has multiple layers and multiple densities. One of the layers of the midsole is a shank that allows the shoe to be lighter and to have a lower-profile which results in the user's foot being positioned closer to the ground; the shank also provides increased heel and midfoot support. As a result of these qualities/characteristics, the shoe can be worn during high impact activities such as running. The motion induced by the shoe mimics the effect of running or walking on a sandy beach or on a giving or uneven surface.

2. Description of the Related Art

Shoes are designed for many purposes—from protection on the job, to performance during athletic activity, to everyday use. Shoes have also been used to promote physical health and activity. Increasingly, shoes have been designed to increase the fitness benefits that users get from everyday uses such as walking. However, there continues to be a need for such shoes that increase the fitness benefits to users yet are comfortable, easy to use, and able to be used for high impact activities such as running.

Walking and running are the easiest and most beneficial forms of exercise. When done properly and with the appropriate footwear, they strengthen the heart, improve cardiovascular health, increase one's stamina and improve posture. Walking and running also help to strengthen and tone one's muscles and maintain joint flexibility.

Prior art shoes have attempted to improve the user's fitness by mimicking walking barefoot. See, for example, U.S. Pat. No. 6,341,432 to Müller. Such shoes can include an abrupt, discrete pivot point provided by a hard inclusion. Consequently, in every step taken during normal walking while wearing such shoes, the user is forced to overcome this abrupt, discrete pivot point. This can result in significant pain and discomfort.

Prior art shoes that have attempted to mimic walking barefoot have been rather large and clunky. They also have not been suitable for running or other high impact activities due to their relatively significant weight, high midsole profile, and low level of heel and midfoot support. In order for a shoe to be optimum for running and other high impact activities, it must have a relatively low profile which allows the foot to be positioned closer to the ground. In addition, the shoe must be light weight and provide sufficient support to the user's foot.

The present invention aims to provide a way of mimicking running or walking on a sandy beach or on a giving or uneven surface, while not inducing any pain or discomfort from doing so. By mimicking running or walking on a sandy beach and/or on an uneven surface, the present invention aims to significantly increase the fitness and health benefits of everyday running or walking by requiring the user to exert additional effort and energy and to use muscles that the user otherwise would not use if wearing ordinary footwear, again all without inducing any pain or discomfort.

SUMMARY OF THE INVENTION

It is an object of the present invention to provide a shoe that can be used during high impact activities such as running and which provides certain fitness benefits not imparted by ordinary shoes. It does this by mimicking the effects of running or walking on a sandy beach or on a giving or uneven surface without inducing any pain or discomfort from doing so.

The present invention is a shoe comprising an upper, an outsole, and a midsole, each having a medial side and a lateral side. In a preferred embodiment, the midsole is affixed to the upper and the outsole is affixed to the midsole. The upper, midsole, and outsole each has a frontmost point and a rearmost point substantially opposite the frontmost point. As the terms imply, each frontmost point is closer to the user's toes than each rearmost point while at the same time each rearmost point is closer to the user's heel than each frontmost is point.

The midsole is unique in that it comprises a plurality of layers. In a preferred embodiment, the midsole comprises an upper layer, a shank and a lower layer. In a preferred embodiment, the upper layer has a first density and the lower layer has a second density. The second density of the lower layer is less than the first density of the upper layer.

Throughout the midsole, the thickness of the upper layer and lower layer may vary. In some instances, the lower layer is thicker than the upper layer or vice versa. In the regions in which the less dense lower layer is thicker, such as the heel, the midsole is less stable. Therefore, it provides the effect of walking or running on sand or an uneven surface. However, in regions in which the less dense lower layer is thicker, the relatively denser upper layer and shank provide some compensating stability to the user's foot. The benefits of the different densities and thicknesses will be further discussed herein below.

The shank is positioned in between the upper layer and the lower layer. The addition of the shank provides at least two groups of benefits. The first group of benefits is that the shank allows the midsole to be constructed with a relatively thinner upper layer. Because the midsole is made thinner due to the shank, the users' foot is placed closer to the ground and therefore provides better footing for high impact activities such as running. Furthermore, the thinner upper layer not only is more aesthetically pleasing, but since there is less material, the midsole is lighter than a midsole with a relatively thick upper layer, thereby making the entire shoe lighter. The second group of benefits is that the shank provides enhanced support to the user's foot and thus allows the user to engage in faster paced activities such as running. The shank also disperses the force and pressure from the foot strike more evenly throughout the shoe.

The shoe has a front tip that is located at the farthest forward point of the shoe when moving from the rear portion to the front portion. The shoe has a rear tip that is located at the farthest rearward point of the shoe when moving from the front portion to the rear portion. In a preferred embodiment, the front tip coincides with the frontmost point of the upper, the frontmost point of the midsole, or the frontmost point of the outsole while the rear tip coincides with the rearmost point of the upper, the rearmost point of the midsole, or the rearmost point of the outsole. In a preferred embodiment, the frontmost point of the upper, the frontmost point of the midsole, and the frontmost point of the outsole are all located relatively close to one another while the rearmost point of the upper, the rearmost point of the midsole, and the rearmost point of the outsole are all located relatively close to one another.

The upper, midsole, and outsole each has a toe region. The toe region includes the region that extends substantially from the medial side to the lateral side at a location that begins in the vicinity of the front tip of the shoe and extends from there to a location that is approximately one third of the distance toward the rear tip of the shoe.

The upper, midsole, and outsole each has a heel region. The heel region includes the region that extends substantially from the medial side to the lateral side at a location that begins in the vicinity of the rear tip of the shoe and extends from there to a location that is approximately one third of the distance toward the front tip of the shoe.

The upper, midsole, and outsole each has a middle region. The middle region includes the region that extends substantially from the medial side to the lateral side at a location that extends approximately between the toe region and the heel region.

In a preferred embodiment, the midsole further comprises an upper layer, shank and a lower layer, the upper layer having a first density and the lower layer having a second density different from the first density. In between the upper layer and lower layer, there is a shank that extends longitudinally from the heel region to the toe region. The upper layer, the shank and the lower layer each has a top surface and a bottom surface.

In a preferred embodiment, the bottom surface of the upper layer rests on the top surface of the shank, and the bottom surface of the shank rests on the top surface of the lower layer.

In a preferred embodiment, the shank extends from the heel region to the toe region and extends longitudinally along the entire midsole. However, without deviating from the scope of the invention, the shank may extend from the heel region to the middle region or part of the toe region without extending the entire length of the shoe.

In a preferred embodiment, the bottom surface of the upper to layer is in substantially continuous contact with, and substantially conforms to, the top surface of the shank. Likewise, the bottom surface of the shank is in substantially continuous contact with, and substantially conforms to, the top surface of the lower layer.

In a preferred embodiment, the shank is comprised of two portions, a top portion and a bottom portion. The top portion and the bottom portion of the shank can be separate pieces which are affixed together or alternatively they can comprise one unitary structure.

In a preferred embodiment, as the shank longitudinally extends along the midsole from the heel region to the toe region, the bottom surface of the shank forms a single longitudinal concavity (as defined below) that occupies a substantial portion of the heel region and terminates at a point in the middle region. Upon termination of the longitudinal concavity, the bottom surface of the shank forms a longitudinal convexity (as defined below) that occupies a portion of the middle region. The longitudinal convexity then terminates. Upon termination of the longitudinal convexity, a second longitudinal concavity begins on the bottom surface of the shank. The second longitudinal concavity on the bottom surface of the shank occupies a portion of the middle and/or toe regions of the midsole.

In a preferred embodiment, due to the shape of the top portion and bottom portion of the shank, a cavity is formed within the shank. For reference, the cavity begins at a point longitudinally closer to the heel region and that point is referred to as the start of the cavity. The cavity terminates at a point longitudinally closer to the middle region and that point is referred to as the end of the cavity. The cavity is completely open from the lateral to medial side of the shoe. The cavity causes the shank to provide better support to the heel and midfoot areas of the foot and disperses the force and pressure of the foot strike more evenly throughout the shoe.

In a preferred embodiment, the invention includes an outsole that, when no load is applied, gently curves continuously upward in a direction toward the upper beginning at a location near the middle region of the outsole and ending at a location near the rearmost point of the upper.

In this preferred embodiment, the upper layer, shank and the lower layer of the midsole each extend from at least the vicinity of the front tip of the shoe to at least the vicinity of the rear tip of the shoe.

In this preferred embodiment, the upper layer is made from a material having a first density sufficiently dense to provide some support and stabilization of the user's foot. Typically, in this preferred embodiment, the upper layer has a durometer hardness between about 45 and about 65 on the Asker C scale. The upper layer typically has a relatively low compressibility so that it compresses a relatively low, or small, amount under a given load.

The lower layer, which may or may not be made of the same material as the upper layer, has a second density that is different from the first density and is sufficiently low in density and high in compressibility so as to allow the lower layer to compress and deform a higher, or greater, amount under a given weight than the upper layer would compress and deform under that same weight. Typically, the lower layer has a durometer hardness between about 20 and about 45 on the Asker C scale. The density of the lower layer is sufficiently low and the compressibility of the lower layer is sufficiently high so that under normal running or walking conditions, the user's foot, first in the heel region, then in the middle region, and then finally in the toe region, sinks toward the ground as the lower layer compresses and deforms during use.

In this preferred embodiment, the shank is made from a material having a third density sufficiently dense to provide the primary support and stability to the user's foot. Typically, the shank has a durometer hardness between about 50 and about 70 on the Shore D scale. The shank in the area of the heel region and the middle region is relatively thick and rigid and thereby provides support and stability to the user's foot in those areas. In contrast, the shank in the toe area is relatively thin and may even have a fork-like structure or be completely absent, thus allowing the toe region to flex during use.

Due to the hardness and rigidity of the shank, the upper layer of the midsole may be relatively thin or completely absent.

During walking or running while wearing a preferred embodiment of the instant invention, when the curved heel region of the outsole strikes the ground, the heel region of the lower layer, which is less dense and more easily compressed than the upper layer, deforms to a relatively large degree compared to the upper layer and the shank. After each such initial heel region contact with the ground, the user's heel sinks or moves toward the ground more than it would sink or move in a conventional shoe. This sinking or downward movement is due primarily to deflection of the heel region of the outsole and compression of the heel region of the midsole as they each respond to the increasing weight being transmitted through the user's heel as the step progresses and the user's heel continues to bear an increasing amount of the user's weight until it reaches a maximum. The impact is akin to a heel striking a sandy beach or a giving or uneven surface. Then, as the user's weight begins to shift toward the middle region of the shoe, the shoe rolls forward in a smooth motion, without the user having to overcome any abrupt or discrete pivot points. Then the lower layer of the midsole in the middle region and then the toe region compresses and deforms under the increasing weight of the user's foot in those regions as the step progresses. This compression and deformation allows the user's foot to sink further toward the ground than would be the case with a conventional shoe. The user then completes the step by pushing off with the forefoot ball area of the user's foot. This push-off further compresses and deforms the lower layer in the toe region.

As used herein, "longitudinal convexities" and "longitudinal concavities" mean, refer to, and are defined as, respectively, convexities and concavities that lie only in vertical, longitudinal planes that extend from any local frontmost point of the shoe to a corresponding local rearmost point of the shoe when the shoe is in its normal, upright position. As used herein, "transverse convexities" and "transverse concavities" mean, refer to, and are defined as, respectively, convexities and concavities that lie only in vertical, transverse planes that extend from any local medialmost point of the shoe to a corresponding local lateralmost point of the shoe when the shoe is in its normal, upright position.

All convexities and concavities in the instant invention, both longitudinal and transverse, are all identified herein as being on, and being a part of, the bottom surface of the shank. Under this convention, each longitudinal convexity and each transverse convexity identified herein is, to some degree, an outward bulge of the bottom surface of the shank and each longitudinal concavity and each transverse concavity identified herein is, to some degree, an inward depression in the bottom surface of the shank. The inward depression of each longitudinal concavity and of each transverse concavity means that the lower layer is relatively thick wherever the bottom surface of the shank has a longitudinal or to transverse concavity. Similarly, the outward bulge of each longitudinal convexity and of each transverse convexity means that the lower layer is relatively thin wherever the shank has a longitudinal or transverse convexity.

Each concavity and convexity, as described above, has at least five primary variables that control the effect of each such concavity and each such is convexity. These primary variables are (1) the location where each concavity and each convexity is located from a point where it begins to a point where it ends, (2) the sharpness or shallowness of each such concavity or convexity, i.e., its radius of curvature or radii of curvature, (3) the length or wavelength of each such concavity or convexity as measured from a point where it begins to a point where it ends, (4) the amplitude, i.e., the greatest height of each such concavity or the greatest depth of each such convexity, and (5) the firmness or compressibility of the upper layer material with which each such concavity or convexity is formed. These variables are some of the primary means by which the effects of the shoe on the user are controlled. These effects comprise primarily (1) the degree of softness or hardness felt by the user's foot throughout each step while wearing the shoe, (2) the amount of energy and effort needed for the user to complete each step, and (3) the amount of muscle use, control and coordination necessary for the user to maintain the user's balance throughout each step.

The degree of softness or hardness felt by the user's foot immediately after the heel strike is controlled primarily by a longitudinal concavity in the bottom surface of the shank located in the heel region of the lower layer of the midsole. This longitudinal concavity is typically relatively large, i.e., it typically has a long length, a large radius of curvature or radii of curvature, and a large amplitude. This relatively large longitudinal concavity allows a relatively thick lower layer to be used in the heel region that can absorb and soften the initial heel strike of each step. Whereas each longitudinal concavity and each transverse concavity imparts a relatively soft feel to the user's foot while walking, each longitudinal convexity and each transverse convexity imparts a relatively hard feel to the user's foot while walking. This relative hardness is due to the decreased thickness of the soft, highly compressible lower layer at each location where a longitudinal or transverse convexity occurs.

The shank allows the midsole to be thinner because it provides a further hardness and rigidity in addition to or in place of the upper layer. Due to the inclusion of the harder and more rigid shank, the lower layer can compress and, at the same time, guide the user's motion without compromising support and stability. Due to the hardness and rigidity of the shank, as the lower layer sinks toward the ground due to the compressibility of the lower layer, the user's foot is still supported and prevented from excessive lateral movement in the midfoot and heel areas during use.

The amount of energy and effort required by the user in each step is related to the degree of softness or hardness felt by the user as discussed in the preceding paragraph insofar as each longitudinal or transverse concavity corresponds to a softer feel which, in turn, requires more energy and effort to overcome in each step.

The amount of muscle use, control and coordination necessary for the user to maintain the user's balance throughout each step increases in direct proportion to each one of the following: (1) increased size, primarily in wavelength and amplitude, of the longitudinal concavity and/or transverse concavity and (2) increased compressibility of the lower layer. Increased longitudinal and/or transverse concavity size in the form of greater amplitude corresponds to a thicker lower layer. The compressibility of the lower layer is a physical property inherent in the material out of which the lower layer is made. It is a measure of the readiness with which the lower layer compresses under a given load. A high compressibility means that the lower layer is highly compressible and can be compressed a high amount with relative ease. As the compressibility increases, the user must use more muscle control and coordination to maintain the user's balance during each step as the weight of the user compresses the lower layer. This compression is accompanied by a downward movement of the user's foot as it compresses the lower layer during each step. This downward compression movement requires balancing by the user to accommodate inherent instability that accompanies the compression. This inherent instability is also affected by the thickness of the lower layer. This thickness, as mentioned above, increases as longitudinal and/or transverse concavity size of the bottom surface of the shank increases. As the thickness of the lower layer increases, the inherent instability increases. Thus, longitudinal and/or transverse concavities on the bottom surface of the shank contribute to a less stable walking/running nature of the shoe. The relative opposite effect is achieved with a longitudinal and/or transverse convexity on the bottom surface of the shank.

As mentioned above, the instability results in the user having to exert more effort and energy while running or walking than they would if they had been wearing conventional footwear. This, in turn, imparts various fitness benefits to the user such as increased muscle toning, better posture and greater burning of calories.

BRIEF DESCRIPTION OF THE SEVERAL VIEWS OF THE DRAWINGS

By way of example only, selected embodiments and aspects of the present invention are described below. Each such description refers to a particular figure ("FIG.") which shows the described matter. All such figures are shown in drawings that accompany this specification. Each such figure includes one or more reference numbers that identify one or more part(s) or element(s) of the invention.

DETAILED DESCRIPTION OF THE INVENTION

Figure 1:
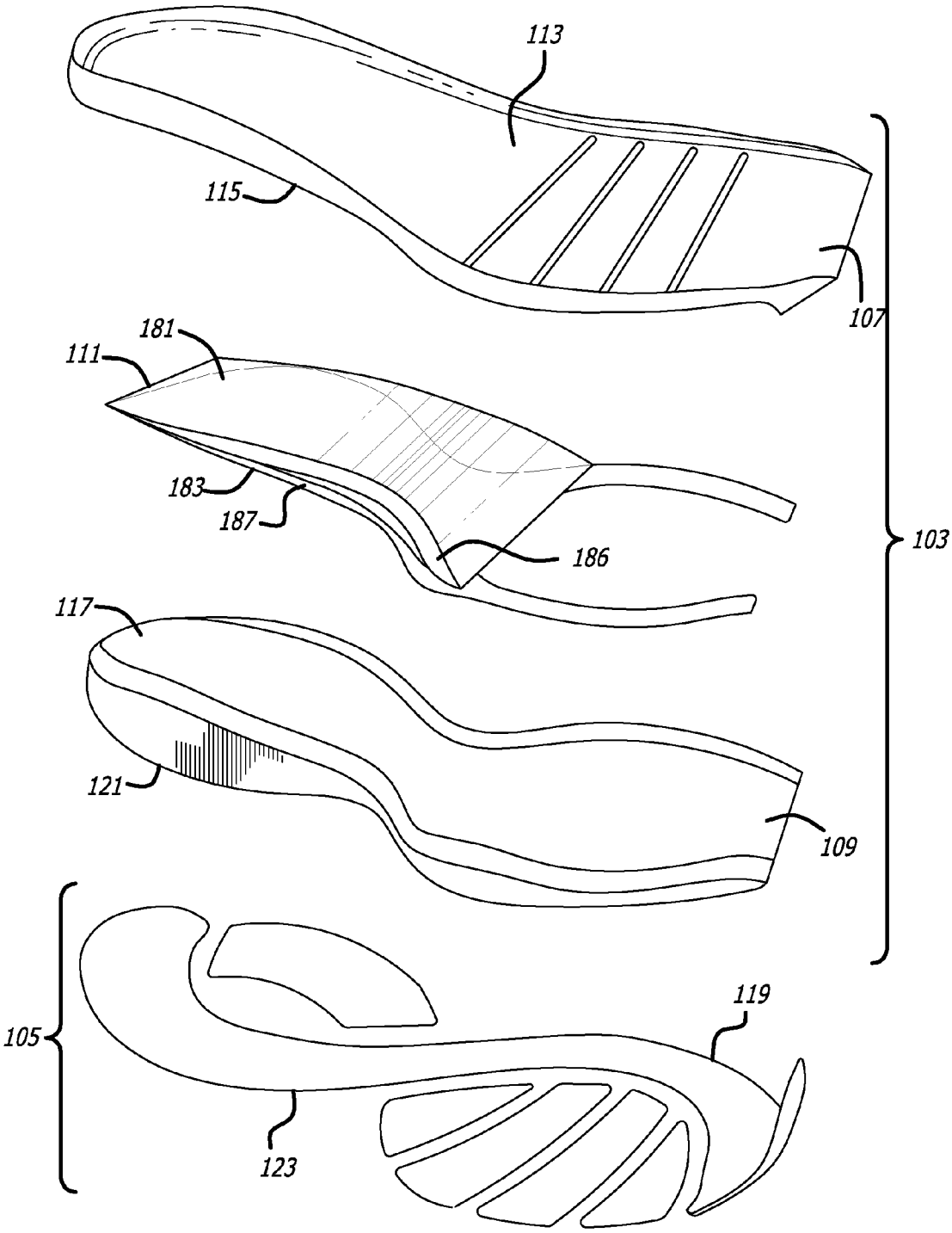
FIG. 1 is an exploded perspective view of an embodiment of the midsole and outsole of the shoe.
Figure 2:
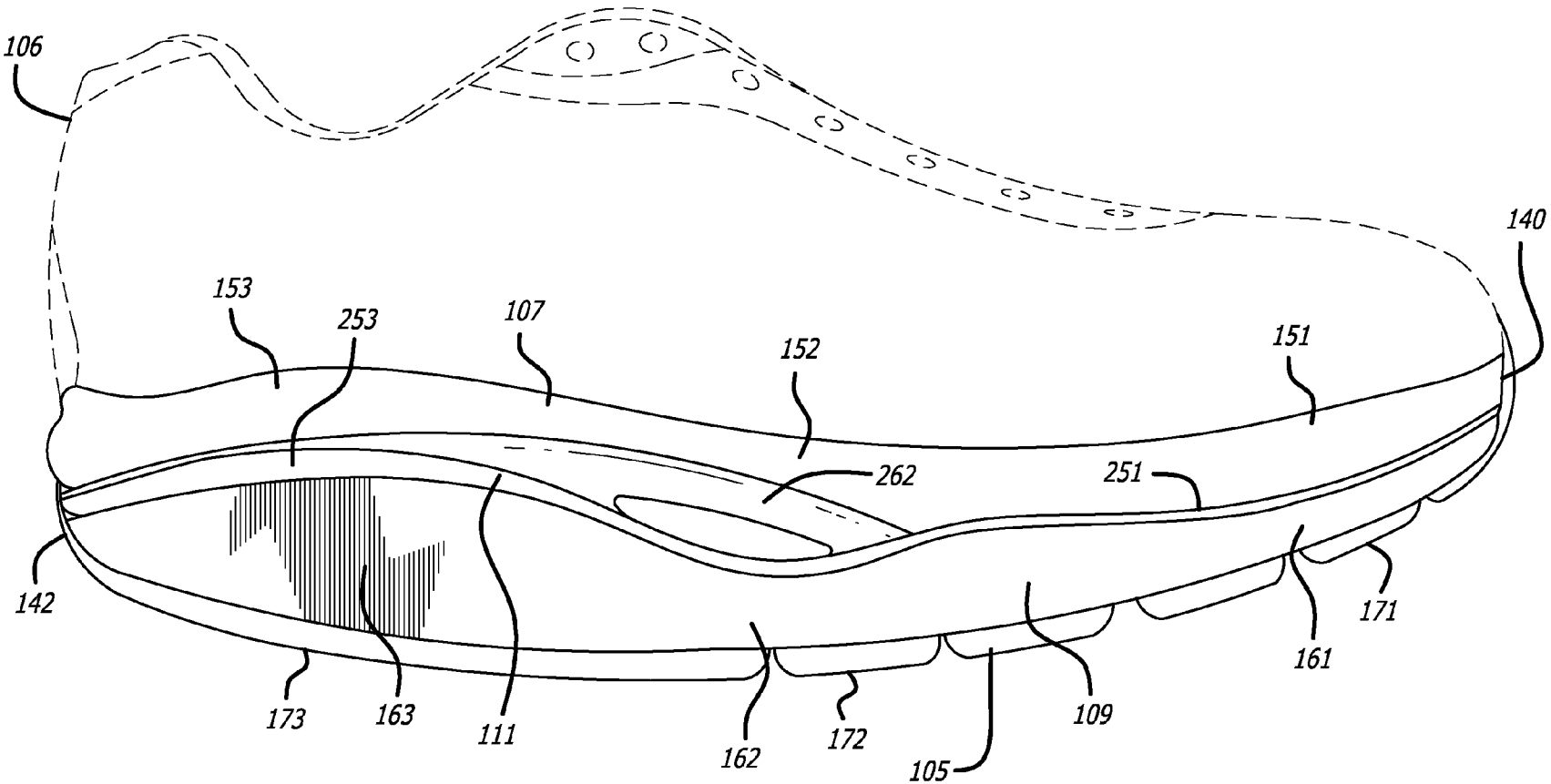
FIG. 2 is a side elevation view of an embodiment of the midsole and outsole of the shoe.
Figure 2A:
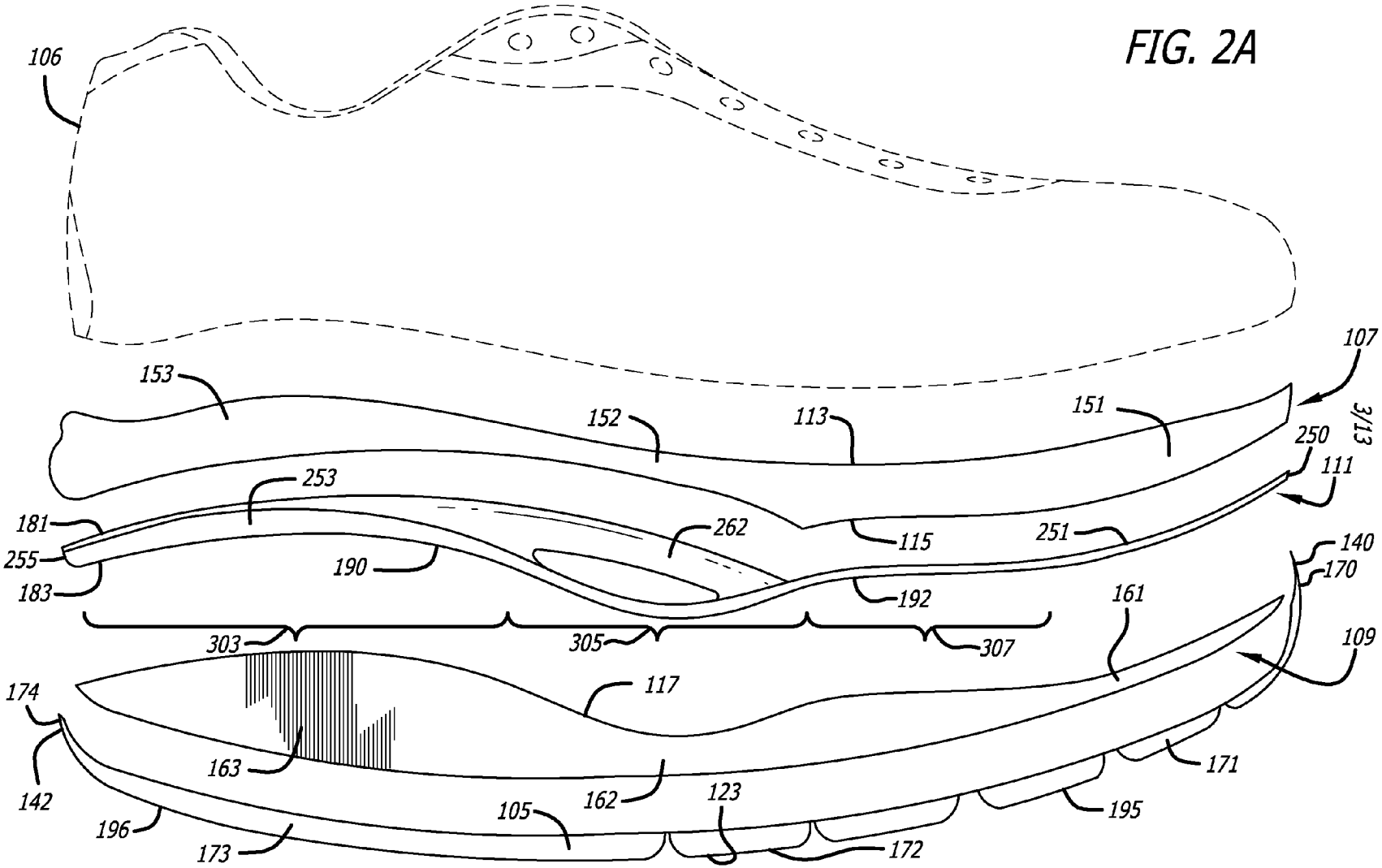
FIG. 2A is an exploded side elevation view of an embodiment of the midsole and outsole of the shoe.

The invention will now be described with reference to the preferred embodiment shown in FIG. 1. FIG. 1 is an exploded perspective view of a preferred embodiment of a midsole 103 and an outsole 105 of the shoe. The outsole 105 is not part of the midsole 103. As shown in FIGS. 1, 2 and 2A, the outsole 105 is below the midsole 103 when the shoe is in its normal, upright position. This normal, upright position is shown with respect to the ground 100 in FIGS. 5A-5D. As used herein, "above" and "below" refer to relative locations of identified elements when the shoe is in this normal, upright position as shown in FIGS. 5A-5D. The midsole 103 is located between the shoe upper 106 and the outsole 105.

The midsole 103, as shown in FIGS. 1, 2 and 2A, comprises an upper layer 107, a shank 111, and a lower layer 109. The upper layer 107 and/or the lower layer 109 may each comprise two or more sub-layers. As described more fully hereinafter in an alternative embodiment, the upper layer 107 may also be eliminated completely.

Figures 3, 3A, 3B, 3C:
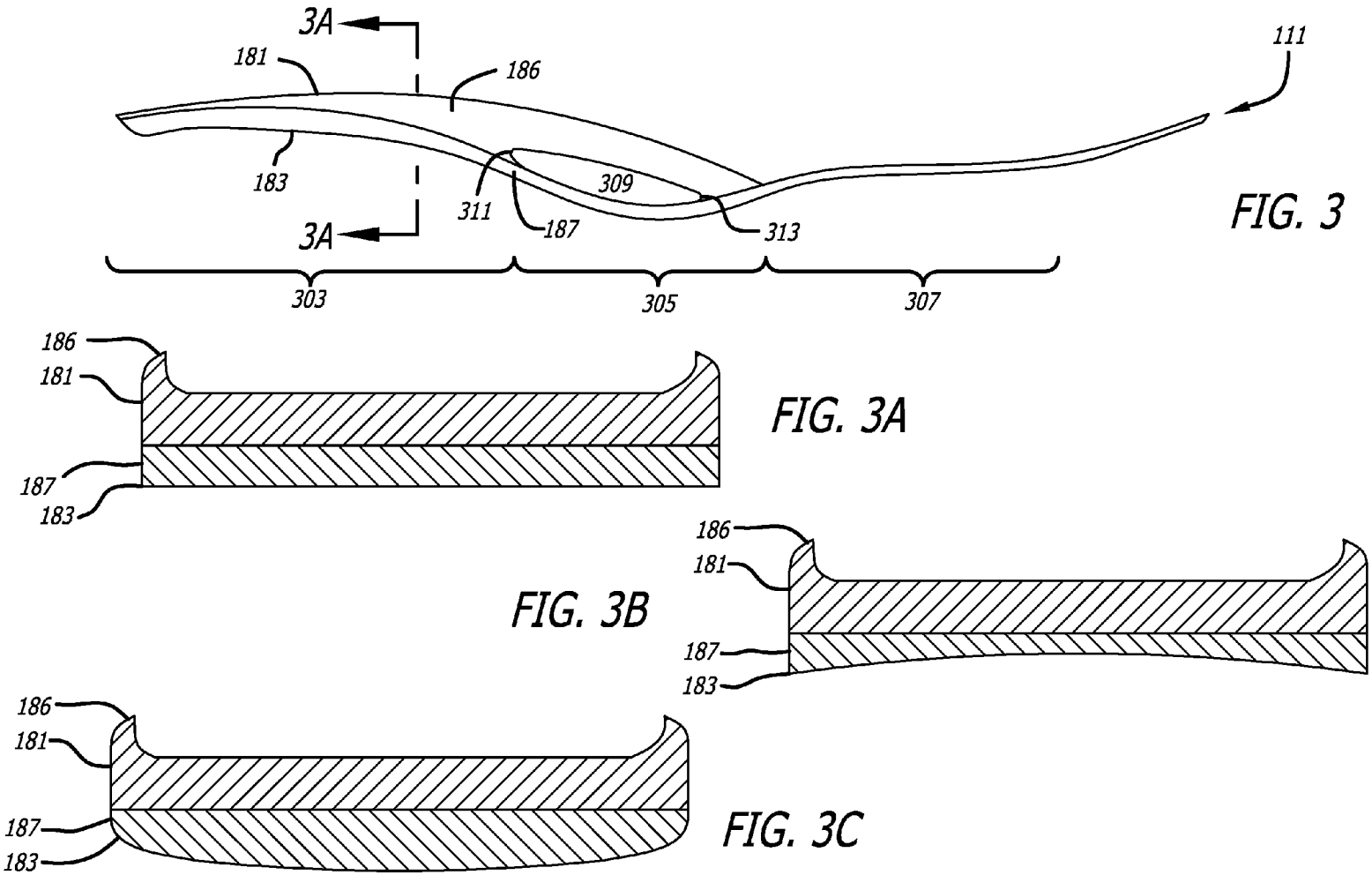
FIG. 3 is a side elevation view of an embodiment of the shank.
FIG. 3A is a front elevation view in cross section of an embodiment of the shank along line 3A in the direction of the appended arrows.
FIG. 3B is a front elevation view in cross section of an alternative embodiment of the shank along line 3A in the direction of the appended arrows.
FIG. 3C is a front elevation view in cross section of another alternative embodiment of the shank along line 3A in the direction of the appended arrows.
Figure 6:
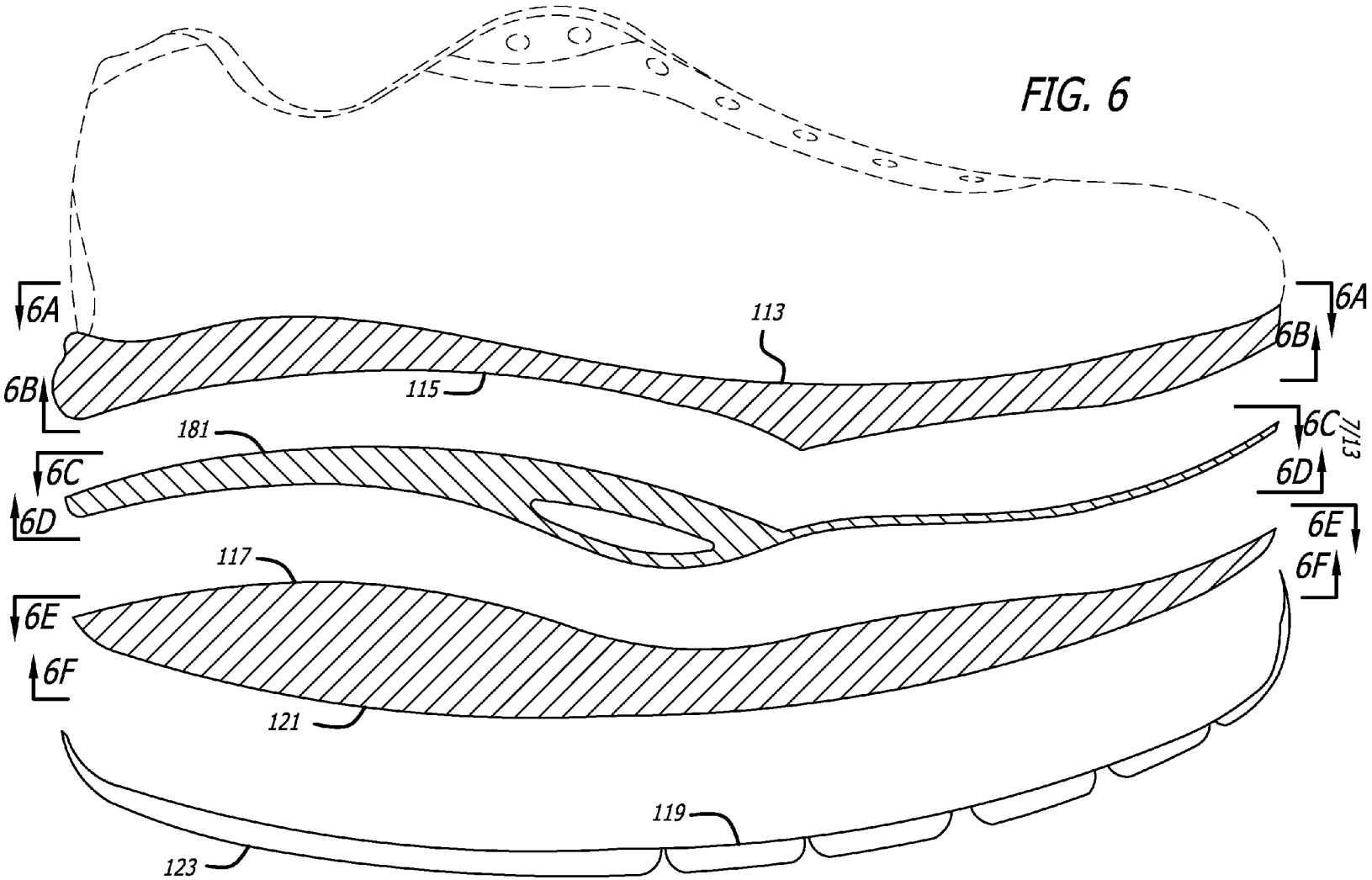
FIG. 6 is an exploded elevation view of FIG. 2 that includes view plane lines.
Figure 6A:
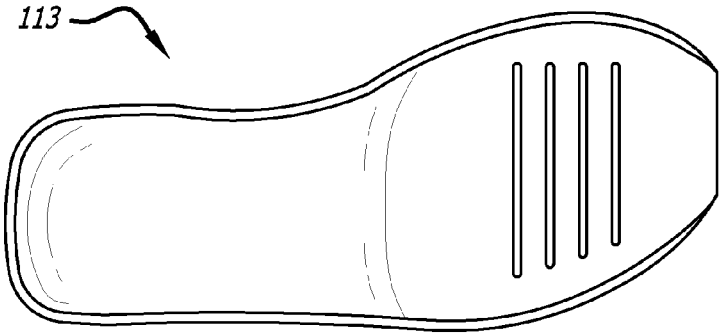
FIG. 6A is a top plan view of the top surface of the upper layer of the midsole along line 6A-6A in the direction of the appended arrows.
Figure 6B:
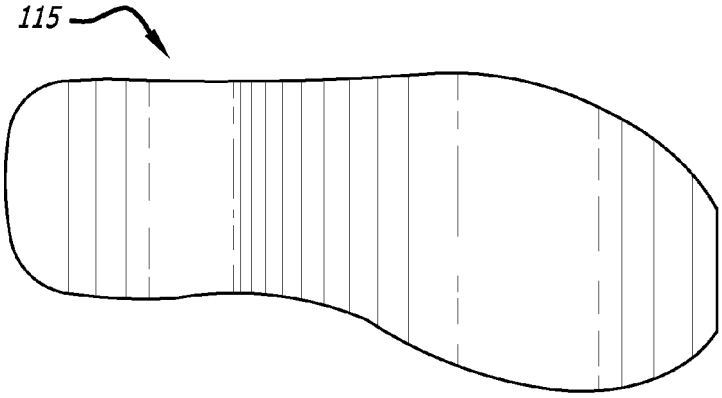
FIG. 6B is a bottom plan view of the bottom surface of the upper layer of the midsole along line 6B-6B in the direction of the appended arrows.
Figure 6C:
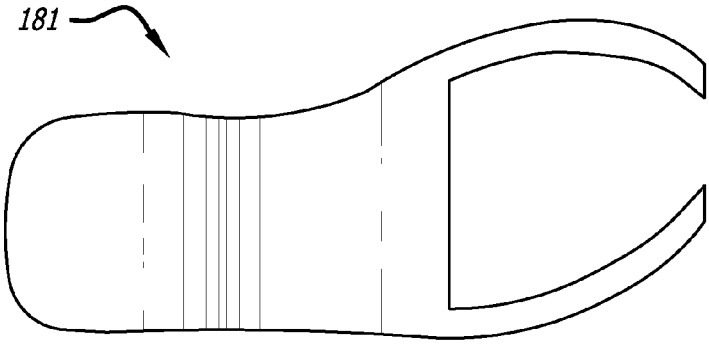
FIG. 6C is a top plan view of the top surface of the shank along line 6C-6C in the direction of the appended arrows.
Figure 6D:
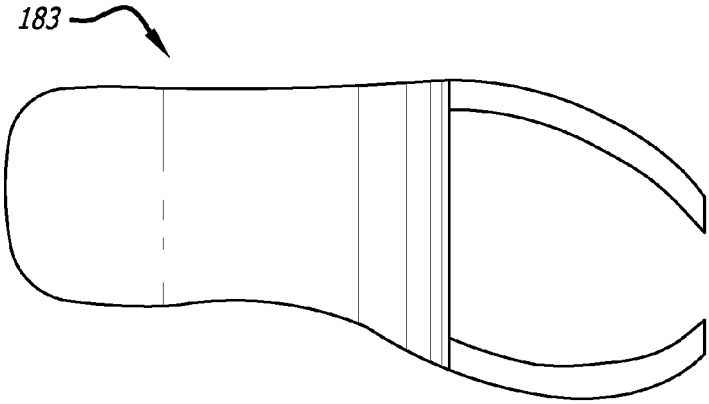
FIG. 6D is a bottom plan view of the bottom surface of the shank along line 6D-6D in the direction of the appended arrows.
Figure 6E:
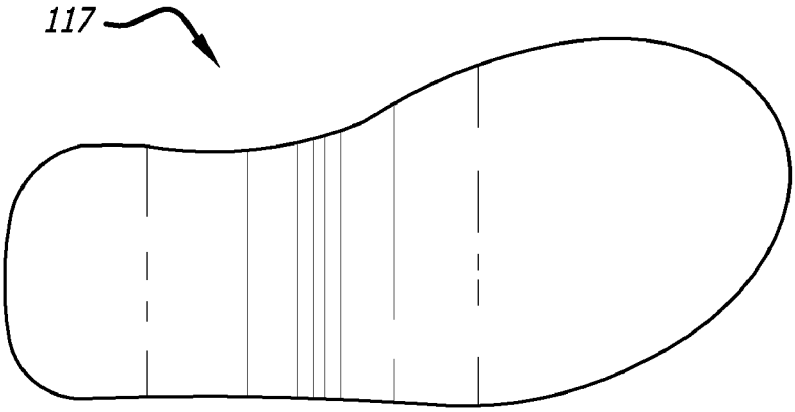
FIG. 6E is a top plan view of the top surface of the lower layer of the midsole along line 6E-6E in the direction of the appended arrows.
Figure 6F:
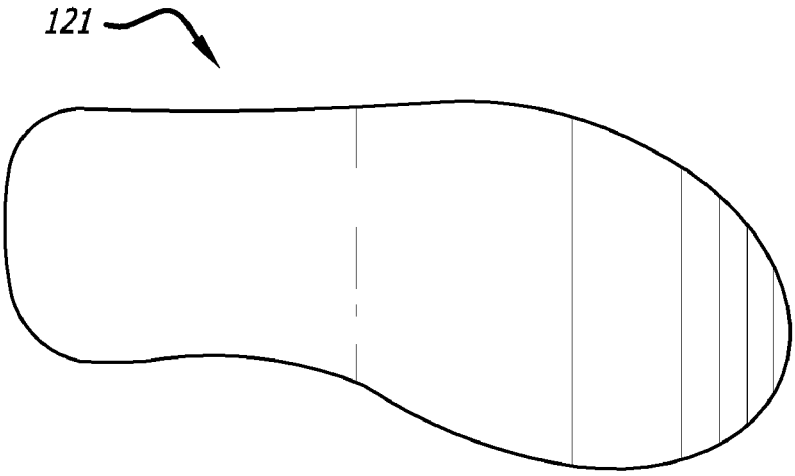
FIG. 6F is a bottom plan view of the bottom surface of the lower layer of the midsole along line 6F-6F in the direction of the appended arrows.

In the preferred embodiment shown in FIGS. 1, 2 and 2A, upper layer 107 has a top surface 113 substantially opposite a bottom surface 115. Top surface 113 is shown in FIG. 6A. Bottom surface 115 is shown in FIG. 6B. The shank 111 has a top surface 181 substantially opposite a bottom surface 183. Top surface 181 is shown in FIG. 6C and bottom surface 183 is shown in FIG. 6D. The shank has a top portion 186 and a bottom portion 187. Top portion 186 and bottom portion 187 are shown in FIG. 3. The lower layer 109 has a top surface 117 substantially opposite a bottom surface 121. Top surface 117 is shown in FIG. 6E. Bottom surface 121 is shown in FIG. 6F. The outsole 105 has a top surface 119 substantially opposite a bottom surface 123. As shown in FIG. 1, when the shoe is in its normal, upright position, the shank 111 is below the upper layer 107. The lower layer 109 is below the shank 111, and the outsole 105 is below the lower layer 109.

FIG. 2 is a side elevation view of an embodiment of the midsole and outsole of the shoe. The shoe has a front tip 140 located at the farthest point toward the front of the shoe and a rear tip 142 located at the farthest point toward the rear of the shoe. The upper layer 107 includes a toe region 151 that extends substantially from the medial side of the shoe to the lateral side of the shoe at a location that begins in the vicinity of the front tip 140 and extends from there to a location that is approximately one third of the distance toward the rear tip 142. The shank 111 includes a toe region 251 that extends substantially from the medial side of the shoe to the lateral side of the shoe at a location that begins in the vicinity of the front tip 140 and extends from there to a location that is approximately one third of the distance toward the rear tip 142. The lower layer 109 includes a toe region 161 that extends substantially from the medial side of the shoe to the lateral side of the shoe at a location that begins in the vicinity of the front tip 140 and extends from there to a location that is approximately one third of the distance toward the rear tip 142. The outsole 105 includes a toe region 171 that extends substantially from the medial side of the shoe to the lateral side of the shoe at a location that begins in the vicinity of the front tip 140 and extends from there to a location that is approximately one third of the distance toward the rear tip 142.

The upper layer 107 includes a heel region 153 that extends substantially from the medial side of the shoe to the lateral side of the shoe at a location that begins in the vicinity of the rear tip 142 and extends from there to a location that is approximately one third of the distance toward the front tip 140. The shank 111 includes a heel region 253 that extends substantially from the medial side of the shoe to the lateral side of the shoe at a location that begins in the vicinity of the rear tip 142 and extends from there to a location that is approximately one third of the distance toward the front tip 140. The lower layer 109 includes a heel region 163 that extends substantially from the medial side of the shoe to the lateral side of the shoe at a location that begins in the vicinity of the rear tip 142 and extends from there to a location that is approximately one third of the distance toward the front tip 140. The outsole 105 includes a heel region 173 that extends substantially from the medial side of the shoe to the lateral side of the shoe at a location that begins in the vicinity of the rear tip 142 and extends from there to a location that is approximately one third of the distance toward the front tip 140.

The upper layer 107 includes a middle region 152 that extends substantially from the medial side of the shoe to the lateral side of the shoe at a location that extends approximately between the toe region 151 and the heel region 153. The shank 111 includes a middle region 262 that extends substantially from the medial side of the shoe to the lateral side of the shoe at a location that extends approximately between the toe region 251 and the heel region 253. The lower layer 109 includes a middle region 162 that extends substantially from the medial side of the shoe to the lateral side of the shoe at a location that extends approximately between the toe region 161 and the heel region 163. The outsole 105 includes a middle region 172 that extends substantially from the medial side of the shoe to the lateral side of the shoe at a location that extends approximately between the toe region 171 and the heel region 173.

Typically, the lower layer 109 of the midsole 103 is on average thicker in the heel region 163 than it is in the toe region 161. The upper layer 107 has a first density. The lower layer 109 has a second density different from the first density and is typically less dense than the first density. The upper layer 107 has a first compressibility and the lower layer 109 has a second compressibility that is different from the first compressibility. The compressibility of the lower layer 109 is typically relatively high. Due to this relatively high compressibility, the lower layer 109 undergoes a relatively high amount of deformation when subjected to a given load. The upper layer 107 is typically made from polyurethane, polyvinyl chloride, rubber or thermal plastic rubber. However, the upper layer 107 can be made from any other material without departing from the scope of the present invention. Typically the upper layer 107 will have a durometer hardness between about 45 and about 65 on the Asker C scale.

FIG. 2A is an exploded side elevation view of FIG. 2. The lower layer 109 is made of a compressible and deformable yet resilient material which may or may not be the same material of which the upper layer 107 is made. Typically the lower layer 109 will have a durometer hardness between about 20 and about 45 on the Asker C scale. The top surface 113 of the upper layer 107 is typically positioned below an insole board (not shown) which is typically positioned below a sockliner (not shown). As shown in FIGS. 2 and 2A, the bottom surface 115 of the upper layer 107 is in substantially continuous contact with the top surface 181 of the shank 111. Due to this substantially continuous contact between the bottom surface 115 of the upper layer 107 and top surface 181 of the shank 111 in this embodiment, bottom surface 115 of the upper layer 107 substantially conforms to top surface 181 of the shank 111. In other embodiments, such substantially continuous contact between bottom surface 115 of the upper layer 107 and top surface 181 of the shank 111 may not be present. The upper layer 107 has a bottom surface 115 that may be connected to the top surface 181 of the shank 111 by either friction and/or an adhesive and/or other similar means. Alternatively, substantially the entire bottom surface 115 of the upper layer 107 may be molded to substantially the entire top surface 181 of the shank 111. Alternatively, the upper layer may be eliminated in alternative embodiments.

The shank 111 has a frontmost point 250 and a rearmost point 255. The shank 111 can be made from polyurethane, polyvinyl chloride, rubber, thermal plastic rubber, carbon fiber or carbon fiber reinforced plastic. However, the shank 111 can be made from any other material without departing from the scope of the present invention. Typically the shank 111 will have a durometer hardness between about 50 and about 70 on the Shore D scale.

The outsole 105 typically curves upwardly in the heel region. The outsole 105 has a frontmost point 170 and a rearmost point 174. When the shoe is in its typical upright, unloaded state, the frontmost point 170 and the rearmost point 174 are both relatively high above the ground 100. From a point at or near the vicinity of the frontmost point 170, the outsole 105 has a gradual downward curve 195 that continues through at least a portion of the toe region 171 of the outsole 105. Starting in the middle region 172, the outsole 105 has a gradual, upward curve 196 that continues to curve upward through at least a portion of the heel region 173 of the outsole 105. This gradual upward curve 196 typically continues until the outsole 105 approaches the vicinity of the rear tip 142 of the shoe. This upward curve 196 is typically sharper than downward curve 195 in the toe region 171. Upward curve 196 may be substantially sharper than shown in FIG. 2A or substantially shallower than shown in FIG. 2A. The outsole 105 has a bottom surface 123 that typically contains grooves and/or patterns for optimal traction and wear.

FIG. 3 is a side elevation view of a preferred embodiment of the shank 111. In the preferred embodiment, the shank 111 comprises a top portion 186 and a bottom portion 187. The shank 111 has a top surface 181 and a bottom surface 183. The bottom surface 183 of the shank 111 has a longitudinal concavity 303, a longitudinal convexity 305 and another longitudinal concavity 307.

The bottom surface 183 of the shank 111 has a longitudinal concavity 303 that comprises at least a downward curve 190 located in at least a portion of the heel region 253. "Downward curve," as used here and throughout this specification, unless otherwise noted, refers to a direction that moves toward the ground 100 from any specified location on the shoe when the shoe is oriented in its typical upright position in which the bottom surface 123 of the outsole 105 is in unloaded contact with the ground 100.

The shank 111 has a frontmost point 250 and a rearmost point 255. Downward curve 190 of the longitudinal concavity 303 begins at or near the vicinity of, the rearmost point 255 of the shank 111 and gradually and continuously descends downwardly from there through a point at or near the vicinity of the middle region 262. The portion of the shank 111 indicated by lines extending from, and associated with, reference numeral 303 indicates the approximate range wherein longitudinal concavity 303 is typically primarily located. Longitudinal concavity 303 may, or may not, be entirely located within the range indicated by the lines extending from, and associated with, reference numeral 303. Longitudinal concavity 303, as shown in FIG. 2A, is relatively shallow due to its large radius of curvature or radii of curvature. Longitudinal concavity 303 may comprise a curve or curves in addition to downward curve 190. The radius of curvature throughout longitudinal concavity 303 may be completely constant, may have one or more constant portions mixed with one or more non-constant portions, or may be completely non-constant. Downward curve 190, as well as any other curve or curves that are part of longitudinal concavity 303, may, at any point on any of those curves, have a slope that is gradual, moderate or steep. Although downward curve 190 of longitudinal concavity 303 is shown in FIG. 2A as beginning near the rearmost point 255, downward curve 190 of longitudinal concavity 303 may instead begin at some other location on the bottom surface 183 of the shank 111. Although longitudinal concavity 303 is shown in FIG. 2A as ending at a location in the middle region 262 or the location where the heel region 253 transitions into the middle region 262, longitudinal concavity 303 may end at some other location on the bottom surface 183 of the shank 111.

The bottom surface 183 of the shank 111, as shown in FIG. 2A, to has a longitudinal concavity 307 that comprises at least an upward curve 192 located in at least a portion of the middle region 262. "Upward curve," as used here and throughout this specification, unless otherwise noted, refers to a direction that moves away from the ground 100 from any specified location on the shoe when the shoe is oriented in its typical upright position in which the bottom surface 123 of the outsole 105 is in unloaded contact with the ground 100.

Upward curve 192 of longitudinal concavity 307 begins at, or near the vicinity of the middle region 262 of the bottom surface 183 and gradually and continuously ascends upwardly from there through at least a portion of the toe region 251. The portion of the bottom surface 183 indicated by lines extending from, and associated with reference numeral 307 indicates the approximate range wherein longitudinal concavity 307 is typically primarily located. Longitudinal concavity 307 may, or may not, be entirely located within the range indicated by the lines extending from, and associated with, reference numeral 307. Longitudinal concavity 307, as shown in FIG. 2A, is relatively shallow due to its large radius of curvature or radii of curvature. Longitudinal concavity 307 may comprise a curve or curves in addition to upward curve 192. The radius of curvature throughout longitudinal concavity 307 may be completely constant, may have one or more constant portions mixed with one or more non-constant portions, or may be completely non-constant. Upward curve 192, as well as any other curve or curves that are part of longitudinal concavity 307, may, at any point on any of those curves, have a slope that is gradual, moderate or steep. Although upward curve 192 of longitudinal concavity 307 is shown in FIG. 2A as beginning near the middle region 262, upward curve 192 of longitudinal concavity 307 may instead begin at some other location on the bottom surface 183. Although longitudinal concavity 307 is shown in FIG. 2A as ending at a location in the toe region 251, longitudinal concavity 307 may end at some other location on the bottom surface 183 of the shank 111.

The bottom surface 183 of the shank 111, as shown in FIG. 2A, has a longitudinal convexity 305 that is defined by downward curve 190 and upward curve 192 and that is typically located in at least a portion of the middle region 262.

Longitudinal convexity 305 may, or may not, be entirely located within the range indicated by the lines extending from, and associated with, reference numeral 305. Longitudinal convexity 305, as shown in FIG. 2A, is relatively shallow due to its large radius of curvature or radii of curvature. Longitudinal convexity 305 may comprise a curve or curves in addition to upward curve 192 and downward curve 190. The radius of curvature throughout longitudinal convexity 305 may be completely constant, may have one or more constant portions mixed with one or more non-constant portions, or may be completely non-constant. Downward curve 190 and upward curve 192, as well as any other curve or curves that are part of longitudinal convexity 305, may, at any point on any of those curves, have a slope that is gradual, moderate or steep. Although longitudinal convexity 305 is shown in FIG. 2A as ending at a location where the middle region 162 transitions into the toe region 161, longitudinal convexity 305 may end at some other location on the bottom surface 183 of the shank 111.

The shank 111, has a cavity 309 which is formed by the top portion 186 and bottom portion 187. The cavity has a beginning point 311 and an end point 313. The cavity 309 begins at the beginning point 311 longitudinally closer to the heel region. The cavity 309 terminates at end point 313 closer to the middle region. The shank 111 has a bottom surface 183 that may be connected to the top surface 117 of the bottom layer 109 by either friction and/or an adhesive and/or other similar means. Alternatively, substantially the entire bottom surface 183 of the shank 111 may be molded to substantially the entire top surface of the bottom layer 109. As shown in FIGS. 2 and 2A, the top surface 117 of the lower layer 109 is in substantially continuous contact with the bottom surface 183 of the shank 111. Due to this substantially continuous contact between the top surface 117 of the lower layer 109 and bottom surface 183 of the shank 111 in this embodiment, top surface 117 of the lower layer 109 substantially conforms to bottom surface 183 of the shank 111. In other embodiments, such substantially continuous contact between top surface 117 of the lower layer 109 and bottom surface 183 of the shank 111 may not be present.

FIG. 3A is a front elevation view in cross section of an embodiment of the shank 111 along line 3A-3A in the direction of the appended arrows. As shown, the bottom surface 183 of the shank 111 along line 3A-3A is straight.

FIG. 3B is a front elevation view in cross section of an alternative embodiment of the shank 111 along line 3A-3A in the direction of the appended arrows. As shown, the bottom surface 183 of the shank 111 along line 3A-3A contains a transverse concavity.

FIG. 3C is a front elevation view in cross section of another alternative embodiment of the shank 111 along line 3A-3A in the direction of the appended arrows. As shown, the bottom surface 183 of the shank 111 along line 3A-3A contains a transverse convexity.

Figure 4:
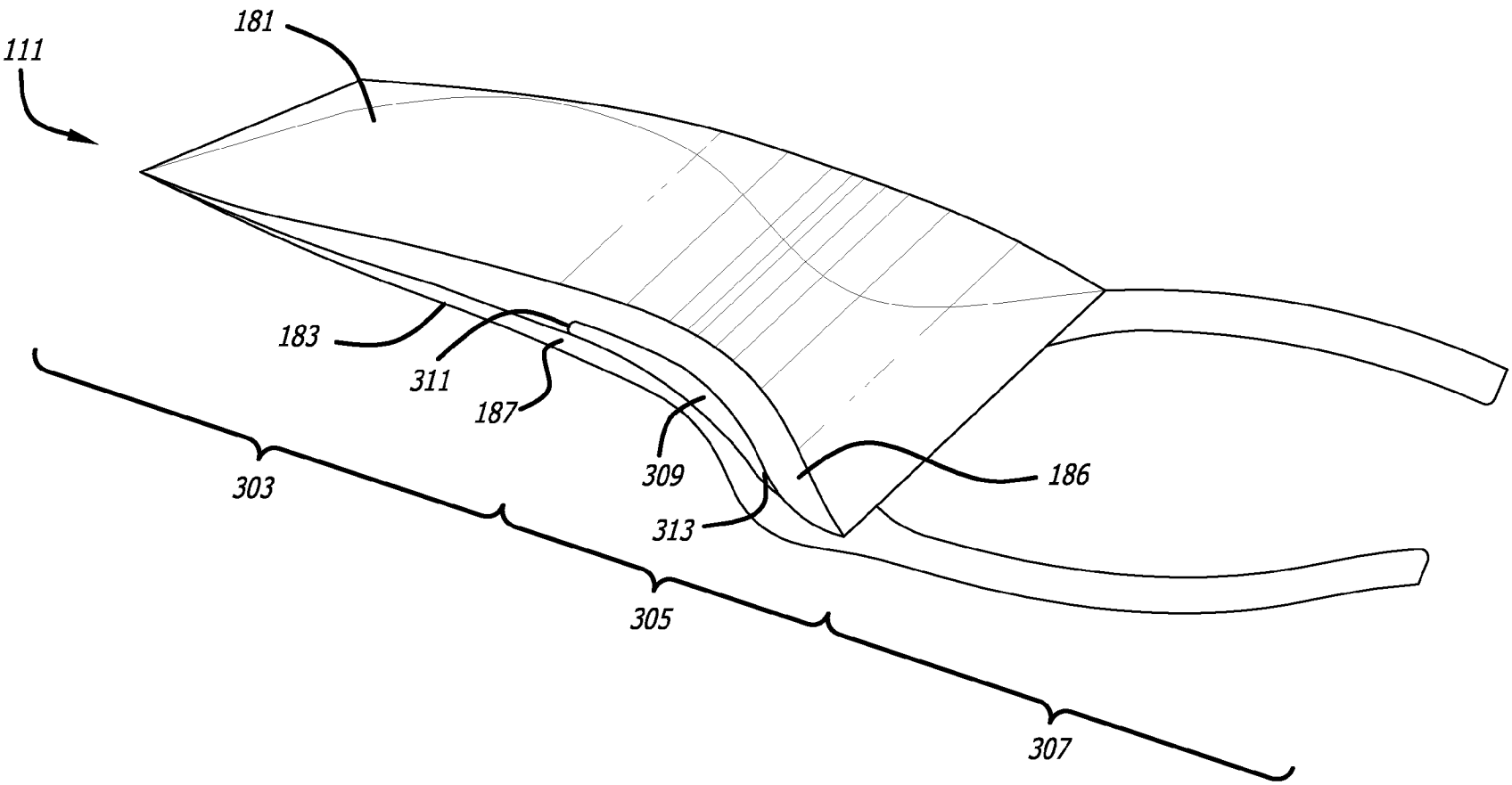
FIG. 4 is a perspective view of an embodiment of the shank.

FIG. 4 is a perspective view of a preferred embodiment of the shank 111 as seen in FIGS. 1, 2, 2A and 3. FIG. 4 illustrates the cavity 309 being open from the lateral to medial side of the shoe.

In normal use of the shoe, each forward step taken by the user begins when the heel region 173 of the outsole 105 begins to make contact with the ground 100. The lower layer 109 of the midsole 103 in the heel region 163 that is made of less dense and more readily compressible material then begins to compress and deform, allowing the heel of the user's foot to sink toward the ground 100 to a greater extent than it would sink while wearing a conventional shoe. Due to longitudinal concavity 303, the lower layer 109 is relatively thick in the heel region 163. Since this relatively thick heel region 163 of the lower layer 109 is also relatively soft and highly compressible, it mimics the effect of walking or running on a sandy beach, thereby requiring the user to exert more energy while walking or running than would be required when walking or running while wearing conventional shoes. Additionally, since the heel region 163 of the lower layer 109 is relatively thick and highly compressible, it has a degree of inherent longitudinal and transverse instability that is not present in conventional shoes. This inherent instability forces the user to engage in a balancing effort and use muscles and muscle control and coordination to maintain a normal walking gait that would not be required with conventional shoes. However, while also maintaining an inherent instability due to the lower layer 109 as discussed above, the shank 111, due to its rigidity and structure is able to provide proper support to the user's heel so that although the heel region 163 compresses and provides instability, the shank 111 provides stability and does not compress.

As the step continues, the user's weight shifts to the middle regions 152, 162, 262, and 172 and the shoe rolls forward in a smooth motion without the user having to overcome any abrupt pivot point. The lower layer 109 of the midsole 103 in the middle region 162 then compresses and deforms, allowing the user's foot in that region to sink toward the ground 100 more than it would sink if the user were wearing conventional shoes, due to the inherent instability due to the lower layer 109 as discussed above. As with the above, the shank 111, due to its rigidity and structure is able to provide proper support to the user's midfoot area. The cavity 309 in the shank 111, may cause the bottom portion 187 of the shank 111 to compress a small amount in the area directly below the cavity 309. This compression provides cushioning and imparts some instability, but the shank 111 still maintains adequate support to the user's foot.

As the step continues, the user's weight then shifts to the toe regions 151, 161, 251, and 171. The lower layer 109 of the midsole 103 in the toe region 161 then compresses and deforms, allowing the user's foot in that region to sink toward the ground 100 more than it would sink if the user were wearing conventional shoes. As shown in FIG. 2A, the thickness of the lower layer 109 in the toe region 161 is typically not as great as it is in the heel region 163. This decrease in thickness of the lower layer 109 results in relatively more stability in the toe region 161. This allows the user, when completing his/her step more control when pushing off with the forefoot ball of the user's foot.

All of this simulates the effect, and imparts the fitness benefits, of running or walking on a sandy beach or on a giving or uneven soft surface regardless of the actual hardness of the surface.

Figure 5A:
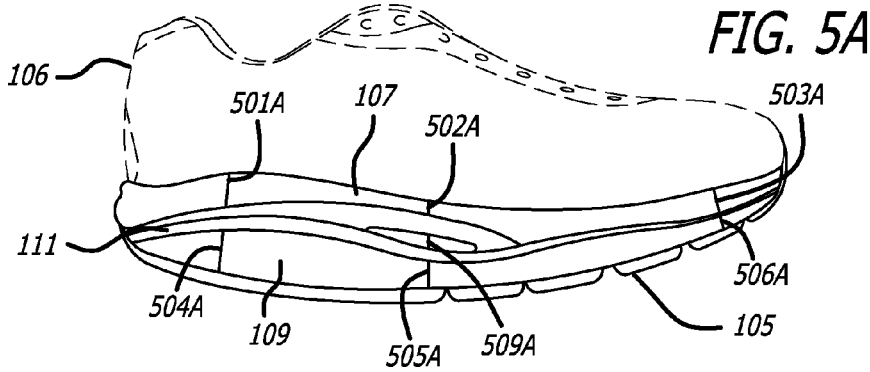
FIG. 5A is a side elevation view of a representative shoe that embodies the instant invention without any load.
Figure 5B:
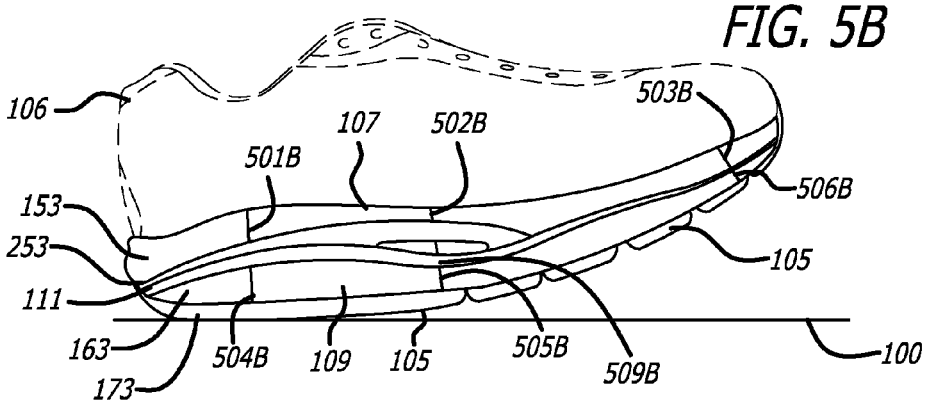
FIG. 5B is a side elevation view of the shoe of FIG. 5A showing the heel region bearing the load of a user.
Figure 5C:
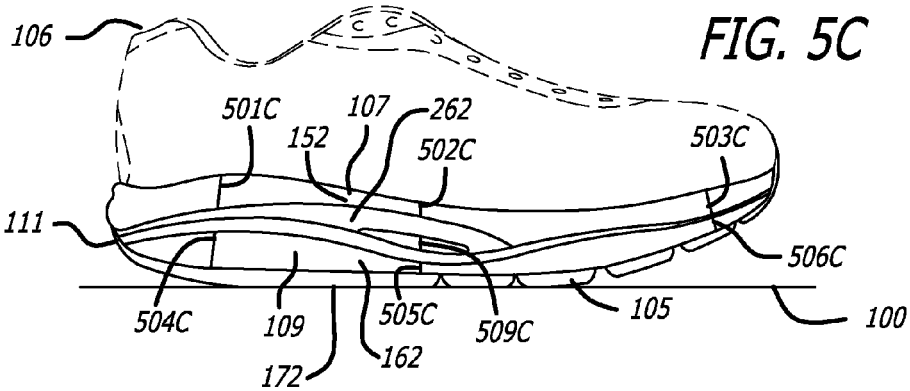
FIG. 5C is a side elevation view of the shoe of FIG. 5A showing the middle region bearing the load of a user.
Figure 5D:
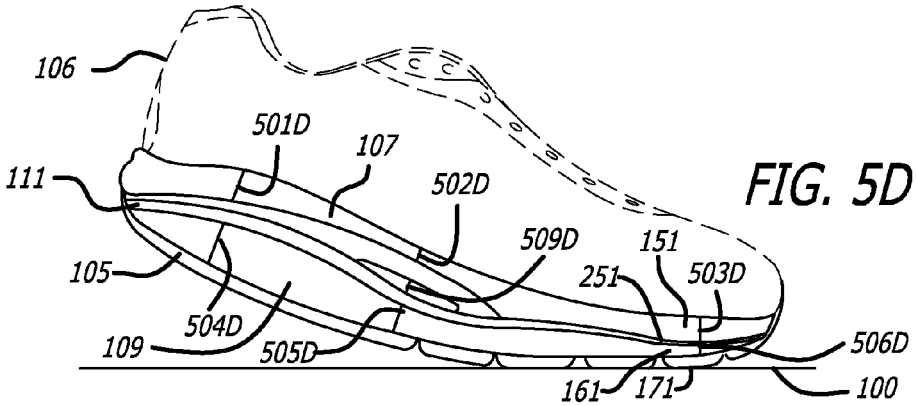
FIG. 5D is a side elevation view of the shoe of FIG. 5A showing the toe region bearing the load of a user.

FIGS. 5A-5D show a side elevation exterior view of a representative shoe that embodies the instant invention. FIG. 5A shows this representative shoe in a fully unloaded state. FIGS. 5B, 5C, and 5D show this representative shoe undergoing normal loading that occurs when a user walks or runs while wearing the shoe. In FIGS. 5A-5D, the shank 111 does not undergo a significant amount of compression aside from the area occupied by cavity 309. Thus the compression of the shank is not shown aside from the area occupied by cavity 309.

In FIGS. 5A-5D, the straight lines identified by, respectively, reference numerals 501A-501D, 502A-502D, and 503A-503D each represent the thickness of the upper layer 107 at the location where each such straight line 501A-501D, 502A-502D, and 503A-503D appears. The straight lines identified by, respectively, reference numerals 504A-504D, 505A-505D, and 506A-506D each represent the thickness of the lower layer 109 at the location where each such straight line 504A-504D, 505A-505D, and 506A-506D appears. The straight lines identified by, respectively, reference numerals 509A-509D each represent the area occupied by the cavity 309. A decrease in the area represented by numeral 509A-509D represents a compression in the cavity 309 of shank 111.

As shown in the unloaded state in FIG. 5A, the upper layer 107 and lower layer 109 are not undergoing any compression. As also shown in FIG. 5A, the outsole 105 is not undergoing any deflection or deformation. In this fully uncompressed state, the thickness of the upper layer 107 and the thickness of the lower layer 109 are each at their respective maximum thickness. This maximum thickness is indicated by, and corresponds to, the length of each straight line 501A-506A, each one of which is at its maximum length as shown in FIG. 5A. Furthermore, the area occupied by the cavity is at its maximum. This maximum area is indicated by and corresponds to the length of the straight line 509A.

FIG. 5B shows the representative shoe in an orientation where the user's heel (not shown) is imparting a load in the heel regions 153, 163, 253, and 173, shown in FIGS. 1 and 2. In normal use of the shoe, each forward step taken by the user begins when the heel region 173 of the outsole 105 begins to make contact with the ground 100. The lower layer 109 of the midsole 103 in the heel region 163 that is made of less dense and more readily compressible material then begins to compress and deform, allowing the heel of the user's foot to sink toward the ground 100 to a greater extent than it would sink while wearing a conventional shoe. Due to longitudinal concavity 303, the lower layer 109 is relatively thick in the heel region 163. Since this relatively thick heel region 163 of the lower layer 109 is also relatively soft and highly compressible, it mimics the effect of walking or running on a sandy beach, thereby requiring the user to exert more energy during use than would be required with conventional shoes. Additionally, since the heel region 163 of the lower layer 109 is relatively thick and highly compressible, it has a degree of inherent longitudinal and transverse instability that is not present in conventional shoes. This inherent instability forces the user to engage in a balancing effort and use muscles and muscle control and coordination to maintain a normal gait that would not be required with conventional shoes. However, while also maintaining an inherent instability due to the lower layer 109 as discussed above, the shank 111, due to its rigidity and structure is able to provide proper support to the user's heel so that although the heel region 163 compresses and provides instability, the shank 111 provides stability and does not compress. Under this loading condition, the heel region 153 of the upper layer 107 is undergoing a relatively small amount of compression. This relatively small amount of compression results in a relatively small decrease in the thickness of the heel region 153 of the upper layer 107. This relatively small decrease in thickness is indicated by 501B. Under this same loading, the heel region 163 of the lower layer 109 is undergoing a relatively large amount of compression. This relatively large amount of compression results in a relatively large decrease in the thickness of the heel region 163 of the lower layer 109. This relatively large decrease in thickness is indicated by 504B. Under this same loading, the heel region 173 of the outsole 105 is undergoing a relatively large amount of deflection. This relatively large amount of deflection in the heel region 173 of the outsole 105 is caused by the heel region 173 conforming to the ground 100 as it bears the load of the user. This deflection and conformity of the heel region 173 of the outsole 105 is indicated by the straight portion of the outsole 105 where it contacts the ground 100 as shown in FIG. 5B.

FIG. 5C shows the representative shoe in an orientation where the user's foot (not shown) is imparting a load in the middle regions 152, 162, 262, and 172, shown in FIGS. 1 and 2. As the step continues, the user's weight shifts to the middle regions 152, 162, 262, and 172 and the shoe rolls forward in a smooth motion without the user having to overcome any abrupt pivot point. The lower layer 109 of the midsole 103 in the middle region 162 then compresses and deforms, allowing the user's foot in that region to sink toward the ground 100 more than it would sink if the user were wearing conventional shoes, due to the inherent instability due to the lower layer 109 as discussed above. As with the above, the shank 111, due to its rigidity and structure is able to provide proper support to the user's midfoot region. The cavity 309 in the shank 111, may cause the bottom portion 187 of the shank 111 to compress a small amount in the area directly below the cavity 309. That compression provides cushioning and imparts some instability, but the shank 111 still maintains adequate support to the user's foot. Under this loading condition, the middle region 152 of the upper layer 107 is undergoing a relatively small amount of compression. This relatively small amount of compression results in a relatively small decrease in the thickness of the middle region 152 of the upper layer 107. This relatively small decrease in thickness is indicated by 502C. Under this same loading, the middle region 162 of the lower layer 109 is undergoing a relatively large amount of compression. This relatively large amount of compression results in a relatively large decrease in the thickness of the middle region 162 of the lower layer 109. This relatively large decrease in thickness is indicated by 505C. Under this same loading, the middle region 172 of the outsole 105 is undergoing a relatively large amount of deflection. This relatively large amount of deflection in the middle region 172 of the outsole 105 is caused by the middle region 172 conforming to the ground 100 as it bears the load of the user. This deflection and conformity of the middle region 172 of the outsole 105 is indicated by the straight portion of the outsole 105 where it contacts the ground 100 as shown in FIG. 5C. Furthermore, the area occupied by the cavity 309 is decreased due to the weight of the user's foot with respect to the ground. The decrease in area of cavity 309 is shown in line 509C.

FIG. 5D shows the representative shoe in an orientation where the user's foot (not shown) is imparting a load in the toe regions 151, 161, 251, and 171, shown in FIGS. 1 and 2. As the step continues, the user's weight then shifts to the toe regions 151, 161, 251, and 171. The lower layer 109 of the midsole 103 in the toe region 161 then compresses and deforms, allowing the user's foot in that region to sink toward the ground 100 more than it would sink if the user were wearing conventional shoes. As shown in FIG. 2A, the thickness of the lower layer 109 in the toe region 161 is typically not as great as it is in the heel region 163. This decrease in thickness of the lower layer 109 results in relatively more stability in the toe region 161. This allows the user, when completing his/her step more control when pushing off with the forefoot ball of the user's foot. Under this loading condition, the toe region 151 of the upper layer 107 is undergoing a relatively small amount of compression. This relatively small amount of compression results in a relatively small decrease in the thickness of the toe region 151 of the upper layer 107. This relatively small decrease in thickness is indicated by 503D. Under this same loading, the toe region 161 of the lower layer 109 is undergoing a relatively large amount of compression. This relatively large amount of compression results in a relatively large decrease in the thickness of the toe region 161 of the lower layer 109. This relatively large decrease in thickness is indicated by 506D. Under this same loading, the toe region 171 of the outsole 105 is undergoing a relatively large amount of deflection. This relatively large amount of deflection in the toe region 171 of the outsole 105 is caused by the toe region 171 conforming to the ground 100 as it bears the load of the user. This deflection and conformity of the toe region 171 of the outsole 105 is indicated by the straight portion of the outsole 105 where it contacts the ground 100 as shown in FIG. 5D. The area in the cavity 309 is now returned to its original state as shown in line 509D, which is equal to line 509A.

Figure 7:
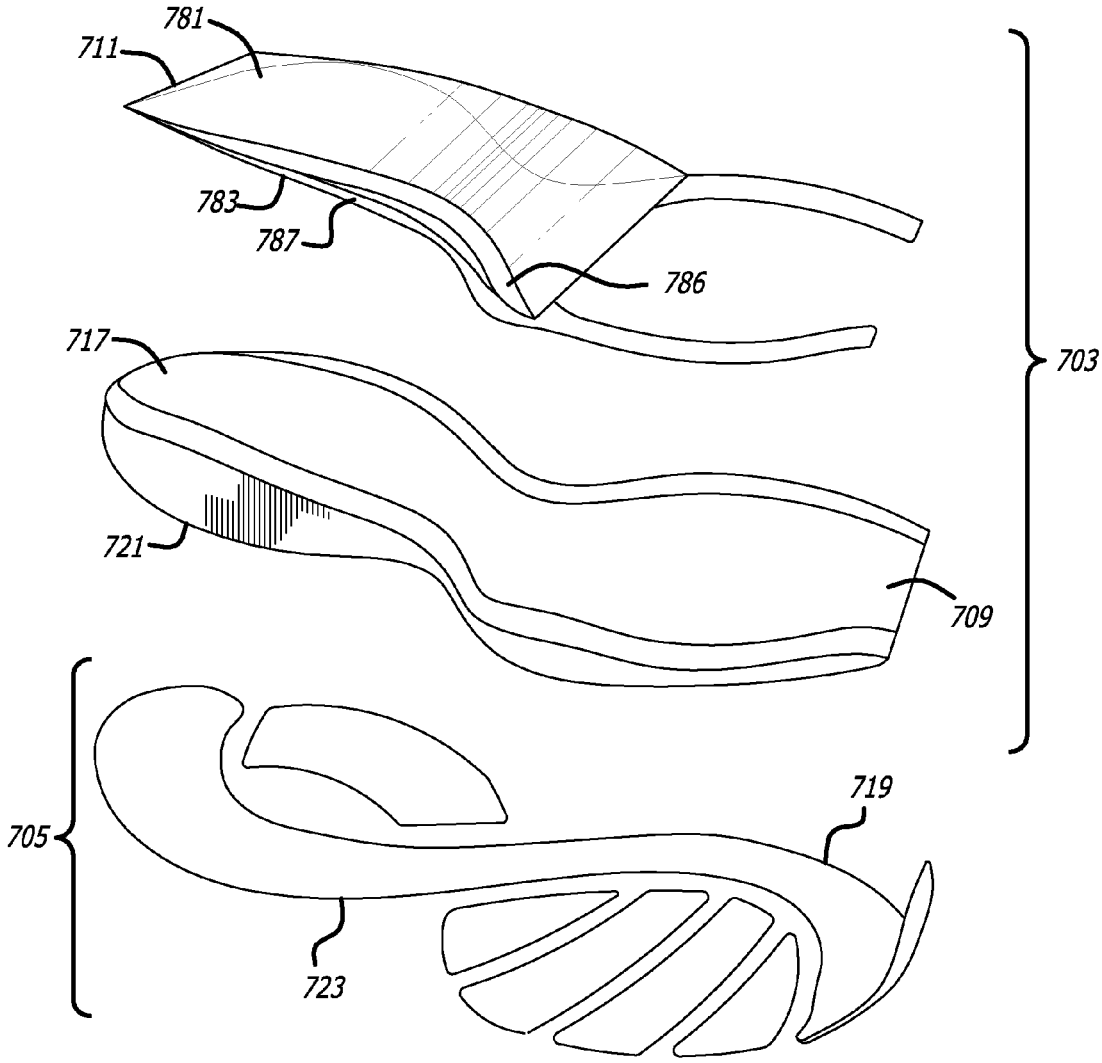
FIG. 7 is an exploded perspective view of an alternative embodiment of the midsole and outsole of the shoe.
Figure 8:
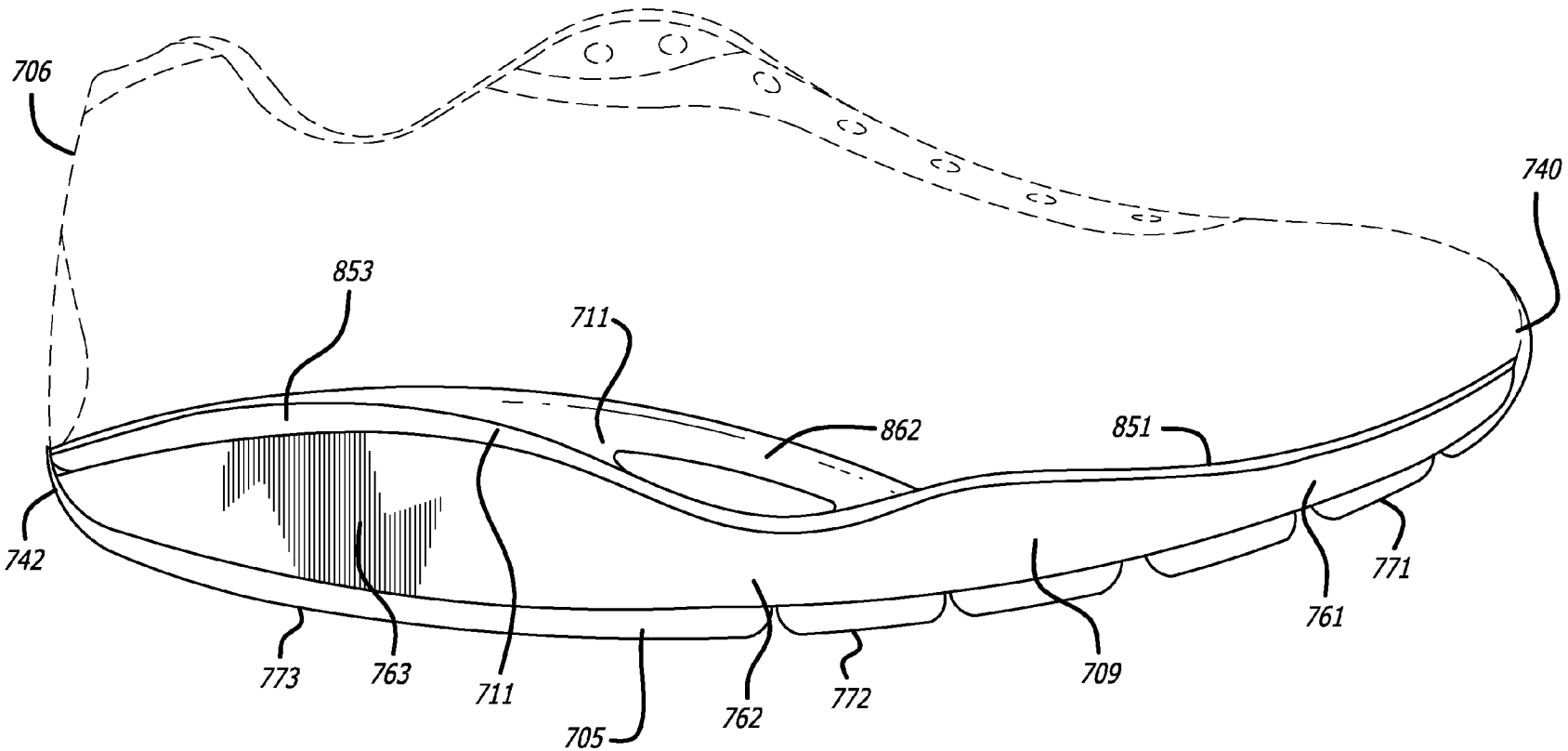
FIG. 8 is a side elevation view of an alternative embodiment of the midsole and outsole of the shoe.
Figure 8A:
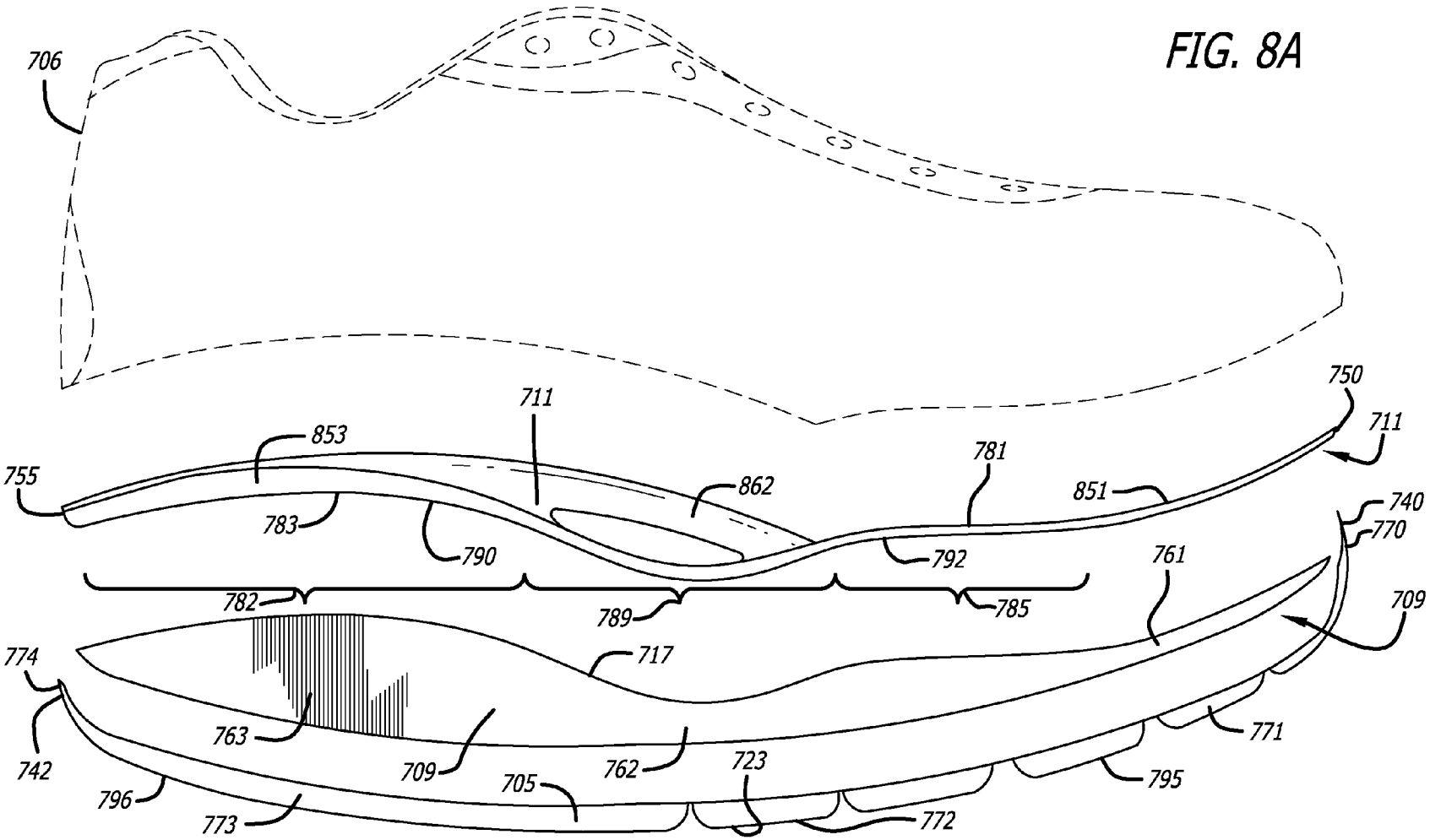
FIG. 8A is an exploded side elevation view of an alternative embodiment of the midsole and outsole of the shoe.

FIGS. 7, 8 and 8A show another embodiment of the invention. The midsole 703 in this alternative embodiment does not have an upper layer but rather is comprised of a shank 711 and a lower layer 709. The lower layer 709 can be comprised of two or more sub-layers.

In this alternative embodiment, lower layer 709 has a top surface 717 substantially opposite a bottom surface 721. The shank 711 has a top surface 781 substantially opposite a bottom surface 783. The shank has a top portion 786 and a bottom portion 787 similar to the embodiment of shank 111 shown in FIG. 3. The outsole 705, which is not part of the midsole 703, has a top surface 719 substantially opposite a bottom surface 723. As shown in FIG. 7, when the shoe is in its normal, upright position, the lower layer 709 is below the shank 711 and the outsole 705 is below the lower layer 709.

FIG. 8 is a side elevation view of the alternative embodiment. The shoe has a front tip 740 located at the farthest point toward the front of the shoe and a rear tip 742 located at the farthest point toward the rear of the shoe. The shank 711 includes a toe region 851 that extends substantially from the medial side of the shoe to the lateral side of the shoe at a location that begins in the vicinity of the front tip 740 and extends from there to a location that is approximately one third of the distance toward the rear tip 742. The lower layer 709 includes a toe region 761 that extends substantially from the medial side of the shoe to the lateral side of the shoe at a location that begins in the vicinity of the front tip 740 and extends from there to a location that is approximately one third of the distance toward the rear tip 742. The outsole 705 includes a toe region 771 that extends substantially from the medial side of the shoe to the lateral side of the shoe at a location that begins in the vicinity of the front tip 740 and extends from there to a location that is approximately one third of the distance toward the rear tip 742.

The shank 711 includes a heel region 853 that extends substantially from the medial side of the shoe to the lateral side of the shoe at a location that begins in the vicinity of the rear tip 742 and extends from there to a location that is approximately one third of the distance toward the front tip 740. The lower layer 709 includes a heel region 763 that extends substantially from the medial side of the shoe to the lateral side of the shoe at a location that begins in the vicinity of the rear tip 742 and extends from there to a location that is approximately one third of the distance toward the front tip 740. The outsole 705 includes a heel region 773 that extends substantially from the medial side of the shoe to the lateral side of the shoe at a location that begins in the vicinity of the rear tip 742 and extends from there to a location that is approximately one third of the distance toward the front tip 740.

The shank 711 includes a middle region 862 that extends substantially from the medial side of the shoe to the lateral side of the shoe at a location that extends approximately between the toe region 851 and the heel region 853. The lower layer 709 includes a middle region 762 that extends substantially from the medial side of the shoe to the lateral side of the shoe at a location that extends approximately between the toe region 761 and the heel region 763. The outsole 705 includes a middle region 772 that extends substantially from the medial side of the shoe to the lateral side of the shoe at a location that extends approximately between the toe region 771 and the heel region 773.

FIG. 8A is an exploded side elevation view of FIG. 8. The lower layer 709 is made of a compressible and deformable yet resilient material. Typically the lower layer 709 will have a durometer hardness between about 20 and about 45 on the Asker C scale. The top surface 781 of the shank 711 is typically positioned below an insole board (not shown) which is typically positioned below a sockliner (not shown). As shown in FIGS. 8 and 8A, top surface 717 of the lower layer 709 is in substantially continuous contact with, and substantially conforms to, the bottom surface 783 of the shank 711. In other embodiments, such substantially continuous contact between top surface 717 and bottom surface 783 may not be present.

The bottom surface 783 of the shank 711, as shown in FIG. 8A, has a longitudinal concavity 782 that comprises at least a downward curve 790 located in at least a portion of the heel region 853.

The shank 711 has a frontmost point 750 and a rearmost point 755. Downward curve 790 of longitudinal concavity 782 begins at, or near the vicinity of, the rearmost point 755 of the shank 711 and gradually and continuously descends downwardly from there through a point at or near the vicinity of the middle region 862. The portion of the bottom surface 783 of the shank 711 indicated by lines extending from, and associated with, reference numeral 782 indicates the approximate range wherein longitudinal concavity 782 is typically primarily located. Longitudinal concavity 782 may, or may not, be entirely located within the range indicated by the lines extending from, and associated with, reference numeral 782. Longitudinal concavity 782, as shown in FIG. 8A, is relatively shallow due to its large radius of curvature or radii of curvature. Longitudinal concavity 782 may comprise a curve or curves in addition to downward curve 790. The radius of curvature throughout longitudinal concavity 782 may be completely constant, may have one or more constant portions mixed with one or more non-constant portions, or may be completely non-constant. Downward curve 790, as well as any other curve or curves that are part of longitudinal concavity 782, may, at any point on any of those curves, have a slope that is gradual, moderate or steep. Although downward curve 790 of longitudinal concavity 782 is shown in FIG. 8A as beginning near the rearmost point 774, downward curve 790 of longitudinal concavity 782 may instead begin at some other location on the shank 711. Although longitudinal concavity 782 is shown in FIG. 8A as ending at a location in the middle region 862 or the location where the heel region 853 transitions into the middle region 862, longitudinal concavity 782 may end at some other location on the bottom surface 783 of the shank 711.

The bottom surface 783 of the shank 711, as shown in FIG. 8A, has a longitudinal concavity 785 that comprises at least an upward curve 792 located in at least a portion of the middle region 862. Upward curve 792 of longitudinal concavity 785 begins at, or near the vicinity of, the middle region 862 of the lower layer 709 and gradually and continuously ascends upwardly from there through at least a portion of the toe region 851. The portion of the bottom surface 783 of the shank 711 indicated by lines extending from, and associated with, reference numeral 785 indicates the approximate range wherein longitudinal concavity 785 is typically primarily located. Longitudinal concavity 785 may, or may not, be entirely located within the range indicated by the lines extending from, and associated with, reference numeral 785. Longitudinal concavity 785, as shown in FIG. 8A, is relatively shallow due to its large radius of curvature or radii of curvature. Longitudinal concavity 785 may comprise a curve or curves in addition to upward curve 792. The radius of curvature throughout longitudinal concavity 785 may be completely constant, may have one or more constant portions mixed with one or more non-constant portions, or may be completely non-constant. Upward curve 792, as well as any other curve or curves that are part of longitudinal concavity 785, may, at any point on any of those curves, have a slope that is gradual, moderate or steep. Although upward curve 792 of longitudinal concavity 785 is shown in FIG. 8A as beginning near the middle region 762, upward curve 792 of longitudinal concavity 785 may instead begin at some other location on the bottom surface 783 of the shank 711. Although longitudinal concavity 785 is shown in FIG. 8A as ending at a location in the toe region 851, longitudinal concavity 785 may end at some other location on the bottom surface 783 of the shank 711.

The bottom surface 783 of the shank 711, as shown in FIG. 8A, has a longitudinal convexity 789 that comprises the downward curve 790 and upward curve 792 and that is typically located in at least a portion of the middle region 862. Longitudinal convexity 789 may, or may not, be entirely located within the range indicated by the lines extending from, and associated with, reference numeral 789. Longitudinal convexity 789, as shown in FIG. 8A, is relatively shallow due to its large radius of curvature or radii of curvature. Longitudinal convexity 789 may comprise a curve or curves in addition to upward curve 792 and downward curve 790. The radius of curvature throughout longitudinal convexity 789 may be completely constant, may have one or more constant portions mixed with one or more non-constant portions, or may be completely non-constant. Downward curve 790 and upward curve 792, as well as any other curve or curves that are part of longitudinal convexity 789, may, at any point on any of those curves, have a slope that is gradual, moderate or steep. Although longitudinal convexity 789 is shown in FIG. 8A as ending at a location where the middle region 762 transitions into the toe region 761, longitudinal convexity 789 may end at some other location on the bottom surface 783 of the shank 711.

As shown in FIGS. 8 and 8A, the outsole 705 typically curves upwardly in the heel region. The outsole 705 has a frontmost point 770 and a rearmost point 774. When the shoe is in its typical upright, unloaded state, the frontmost point 770 and the rearmost point 774 are both relatively high above the ground 100. From a point at or near the vicinity of the frontmost point 770, the outsole 705 has a gradual downward curve 795 that continues through at least a portion of the toe region 771 of the outsole 705. Starting in the middle region 772, the outsole 705 has a gradual, upward curve 796 that continues to curve upward through at least a portion of the heel region 773 of the outsole 705. This gradual upward curve 796 typically continues until the outsole 705 approaches the vicinity of the rear tip 742 of the shoe. This upward curve 796 is typically sharper than downward curve 795 in the toe region 771. Upward curve 796 may be substantially sharper than shown in FIG. 8A or substantially shallower than shown in FIG. 8A.

Figure 9A:
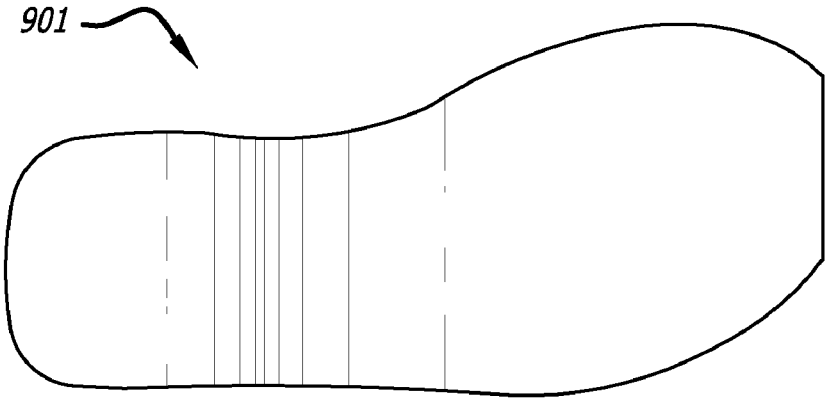
FIG. 9A is a top plan view of the bottom surface of an alternative embodiment of the shank along line 6C-6C in the direction of the appended arrows.

FIG. 9A depicts a top plan view of the top surface of an alternative embodiment of a shank 901 along line 6C-6C in the direction of the appended arrows. As shown, the shank 901 shown in FIG. 9A differs from the shank 111 shown in FIG. 6C. The shank 901, instead of having a fork-like structure as shown in 6C, does not have any open areas and occupies substantially all of the area from the medial to the lateral side of the shoe between the rear tip 142 and the front tip 140.

Figure 9B:
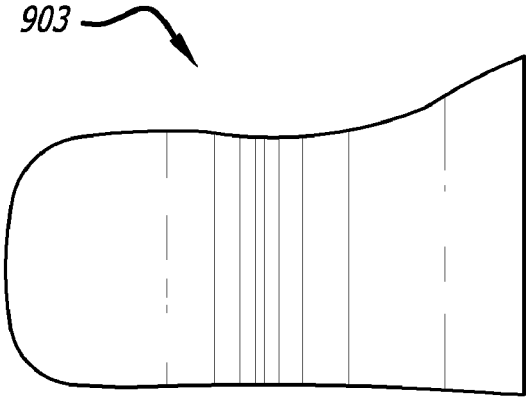
FIG. 9B is a top plan view of the bottom surface of an alternative embodiment of the shank along line 6C-6C in the direction of the appended arrows.

FIG. 9B depicts a top plan view of the top surface of another alternative embodiment of a shank 903 along line 6C-6C in the direction of the appended arrows. As shown, the shank 903 shown in FIG. 9B differs from the shank 111 shown in FIG. 6C. The shank 903, instead of extending from the rear tip 142 to the front tip 140, extends only from the rear tip 142 to an area close to the middle region 262 and does not extend to the front tip 140.

While the foregoing detailed description sets forth selected embodiments of a shoe in accordance with the present invention, the above description is illustrative only and not limiting of the disclosed invention. The claims that follow herein collectively cover the foregoing embodiments. The following claims further encompass additional embodiments that are within the scope and spirit of the present invention.

What is claimed is:

1. A shoe having an upper, a midsole, and an outsole, wherein said midsole comprises:

a toe region, a middle region, a heel region, an upper layer, a shank and a lower layer, wherein said shank has a bottom surface, said lower layer has a top surface, said lower layer being located substantially between the outsole and the shank, said shank being located substantially between, the lower layer and the upper layer, the bottom surface of said shank substantially facing the top surface of said lower layer, and said upper layer, said shank, and said lower layer each having a durometer hardness wherein the durometer hardness of the upper layer is greater than the durometer hardness of the lower layer, the durometer hardness of the shank is greater than the durometer hardness of the upper layer.

2. The shoe of claim 1 wherein said bottom surface of said shank has at least a longitudinal concavity and at least a longitudinal convexity, wherein a said longitudinal concavity occupies a substantial portion of the heel region, and a said longitudinal convexity occupies a portion of the middle region.

3. The shoe of claim 1 wherein said bottom surface of said shank has a plurality of longitudinal concavities and at least one longitudinal convexity, said plurality of longitudinal concavities comprising at least a first longitudinal concavity and a second longitudinal concavity, wherein said first longitudinal concavity occupies a substantial portion of the heel region and said second longitudinal concavity occupies a portion of the to region, and said longitudinal convexity occupies a portion of the middle region.

4. The shoe of claim 1 wherein said shank contains a cavity in a portion of said middle region.

5. The shoe of claim 1 wherein said shank occupies a substantial portion of the entire length of the midsole.

6. The shoe of claim 1 wherein said shank occupies a substantial portion of said heel region and a substantial portion of said middle region.

7. The shoe of claim 1 wherein said bottom surface of said shank contains a transverse: concavity or a transverse convexity.

8. A shoe having an upper, a midsole, and an outsole, wherein said midsole comprises:

a toe region, a middle region, a heel region, a shank and a lower layer, wherein said shank has a bottom surface and a top surface, said lower layer has a top surface, said lower layer being located substantially between the outsole and the shank, and the bottom surface of said shank substantially facing the top surface of said lower said shank and said lower layer each having a durometer hardness wherein the durometer hardness of the shank is greater than the durometer hardness of the lower layer, and wherein said shank, occupies a substantial portion of said heel region and a substantial portion of said middle region, wherein said midsole does not extend above the top surface of the shank.

9. The shoe of claim 8 wherein said bottom surface of said shank has at least a longitudinal concavity and at least a longitudinal convexity, wherein a said longitudinal concavity occupies a substantial portion of the heel region, and a said longitudinal convexity occupies a portion of the middle region.

10. The shoe of claim 8 wherein said bottom surface of said shank has a plurality of longitudinal concavities and at least one longitudinal convexity, said plurality of longitudinal concavities comprising at least a first longitudinal concavity and a second longitudinal concavity, wherein said first longitudinal concavity occupies a substantial portion of the heel region and said second longitudinal concavity occupies portion of the toe region, and said longitudinal convexity occupies a portion of the middle region.

11. The shoe of claim 8 wherein said shank contains a cavity in a portion of said middle region.

12. The shoe of claim 8 wherein said shank further occupies a substantial portion of the toe region whereby the shank occupies a substantial portion of the entire length of the midsole.

13. The shoe of claim 8 wherein said bottom surface of said shank contains a transverse concavity or a transverse convexity.

14. The shoe of claim 8 wherein said shank has a durometer hardness of between about 50 and about 70 Shore D.

15. A shoe having an upper, a midsole, and an outsole, wherein said midsole comprises:

a toe region, a middle region, a heel region, an upper layer, 8 shank and a lower layer, wherein said shank has a bottom surface, said lower layer has a top surface, said lower layer being located substantially between the outsole and the shank, said shank being located substantially between the lower layer and the upper layer, the bottom surface of said shank substantially facing the top surface of said lower layer, and said upper layer, said shank and said lower layer each having a durometer hardness wherein the durometer hardness of the upper layer is greater than the durometer hardness of the lower layer, and the of the durometer hardness of the shank is greater than the durometer hardness of the upper layer, and wherein the upper layer has a durometer hardness between about 45 and about 65 on the Asker C scale.

16. The shoe of claim 15 wherein said bottom surface of said shank has at least a longitudinal concavity and at least a longitudinal convexity, wherein a said longitudinal concavity occupies a substantial portion of the heel region, and a said longitudinal convexity occupies a portion of the middle region.

17. The shoe of claim 15 wherein said bottom surface of said shank has a plurality or longitudinal concavities and at least one longitudinal convexity, said plurality of longitudinal concavities comprising at least, a first longitudinal concavity and a second longitudinal concavity, wherein said first longitudinal concavity occupies a substantial portion of the heel region and said second longitudinal concavity occupies a portion of the top region, and said longitudinal convexity occupies a portion of the middle region.

18. The shoe of claim 15 wherein said shank contains a cavity in a portion of said middle region.

19. The shoe of claim 15 wherein said shank occupies a substantial portion of the entire length of the midsole.

20. The shoe of claim 15 wherein said bottom surface of said shank contains a transverse concavity or a transverse convexity.

* * * * *

UNITED STATES PATENT AND TRADEMARK OFFICE

CERTIFICATE OF CORRECTION

PATENT NO. : 7,886,460 B2
APPLICATION NO. : 12/834725
DATED : February 15, 2011
INVENTOR(S) : Savva Teteriatnikov et al.

It is certified that error appears in the above-identified patent and that said Letters Patent is hereby corrected as shown below:

Title Page, Item (73) Assignee "Skecher U.S.A., Inc. II." should read -- Skechers U.S.A., Inc. II. --

Signed and Sealed this
Nineteenth Day of April, 2011

David J. Kappos

David J. Kappos
*Director of the United States Patent and Trademark Office*